US010280922B2

(12) United States Patent
Doepker et al.

(10) Patent No.: US 10,280,922 B2
(45) Date of Patent: May 7, 2019

(54) SCROLL COMPRESSOR WITH AXIAL FLUX MOTOR

(71) Applicant: Emerson Climate Technologies, Inc., Sidney, OH (US)

(72) Inventors: Roy J. Doepker, Lima, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 124 days.

(21) Appl. No.: 15/425,428

(22) Filed: Feb. 6, 2017

(65) Prior Publication Data

US 2018/0223849 A1 Aug. 9, 2018

(51) Int. Cl.

*F04C 18/02* (2006.01)
*F04C 23/00* (2006.01)
*F04C 29/00* (2006.01)

(52) U.S. Cl.

CPC ..... *F04C 29/0085* (2013.01); *F04C 18/023* (2013.01); *F04C 18/0215* (2013.01); *F04C 23/008* (2013.01); *F04C 18/0223* (2013.01); *F04C 2240/40* (2013.01); *F04C 2240/50* (2013.01); *F04C 2240/60* (2013.01)

(58) Field of Classification Search

CPC .. F04C 23/008; F04C 29/0085; F04C 18/023; F04C 18/0215; F04C 2240/50

USPC ..... 417/420

See application file for complete search history.

(56) References Cited

U.S. PATENT DOCUMENTS 4,105,374 A 8/1978 Scharf
4,781,550 A * 11/1988 Morishita ..... F04C 18/023 418/188
4,846,639 A 7/1989 Morishita et al.
5,073,093 A * 12/1991 Takagi ..... F04C 18/0215 417/410.5

(Continued)

FOREIGN PATENT DOCUMENTS

JP H02140477 A 5/1990
JP H02207190 A 8/1990

(Continued)

OTHER PUBLICATIONS

Frank, et al., NASA Tech Briefs, Ring Motors—Design Flexibility for Innovative Configurations, Sep. 1, 2014.

(Continued)

*Primary Examiner* — Peter J Bertheaud
(74) *Attorney, Agent, or Firm* — Harness, Dickey & Pierce, P.L.C.

(57) ABSTRACT

A compressor may include a first compression member, a second compression member, and a motor assembly. The second compression member is movable relative to the first compression member and cooperates with the first compression member to define a compression pocket therebetween. The motor assembly drives one of the first and second compression members relative to the other one of the first and second compression members. The motor assembly includes a stator and a rotor. The rotor is rotatable relative to the stator about a rotational axis. The stator surrounds the rotational axis. The rotor may include magnets that are arranged around the rotational axis. The magnets may be spaced apart from the stator in an axial direction that is parallel to the first rotational axis.

15 Claims, 9 Drawing Sheets

(56) References Cited

U.S. PATENT DOCUMENTS

| | | | | |
|---|---|---|---|---|
| 5,090,876 | A * | 2/1992 | Hashizume | F04C 18/023 417/366 |
| 5,099,658 | A | 3/1992 | Utter et al. | |
| 5,129,798 | A | 7/1992 | Crum et al. | |
| 5,211,031 | A | 5/1993 | Murayama et al. | |
| 5,256,042 | A | 10/1993 | McCullough et al. | |
| 5,256,044 | A | 10/1993 | Nieter et al. | |
| 5,713,731 | A | 2/1998 | Utter et al. | |
| 5,791,883 | A * | 8/1998 | Ban | F04C 18/0215 417/410.5 |
| 6,359,357 | B1 | 3/2002 | Blumenstock | |
| 6,616,430 | B2 * | 9/2003 | Mori | F04C 18/023 418/188 |
| 6,712,589 | B2 * | 3/2004 | Mori | F01C 17/063 417/410.5 |
| 7,201,567 | B2 | 4/2007 | Wiertz et al. | |
| 7,344,367 | B2 | 3/2008 | Manole | |
| 8,058,762 | B2 | 11/2011 | Asano | |
| 8,179,016 | B2 * | 5/2012 | Asano | F04C 23/008 310/156.32 |
| 8,373,326 | B2 | 2/2013 | Enomoto et al. | |
| 8,894,388 | B2 | 11/2014 | Lee et al. | |
| 2002/0182094 | A1 | 12/2002 | Mori et al. | |
| 2008/0087033 | A1 | 4/2008 | Bae et al. | |
| 2009/0104060 | A1 | 4/2009 | Sato et al. | |
| 2010/0164313 | A1 | 7/2010 | Langford et al. | |
| 2010/0225195 | A1 | 9/2010 | Asano et al. | |
| 2011/0002797 | A1 | 1/2011 | Takeuchi et al. | |
| 2011/0038737 | A1 | 2/2011 | Conry et al. | |
| 2012/0131945 | A1 | 5/2012 | Huang et al. | |
| 2013/0181565 | A1 | 7/2013 | Petro et al. | |
| 2016/0043602 | A1 | 2/2016 | Hosek et al. | |
| 2018/0013336 | A1 | 1/2018 | Li | |
| 2018/0223842 | A1 | 8/2018 | Stover et al. | |
| 2018/0223843 | A1 | 8/2018 | Doepker et al. | |
| 2018/0223848 | A1 | 8/2018 | Doepker et al. | |
| 2018/0224171 | A1 | 8/2018 | Doepker et al. | |
| 2018/0363654 | A1 | 12/2018 | Doepker et al. | |

FOREIGN PATENT DOCUMENTS

| | | | |
|---|---|---|---|
| JP | H07229481 | A | 8/1995 |
| JP | 2004052657 | A | 2/2004 |
| JP | 2015124653 | A | 7/2015 |

OTHER PUBLICATIONS

McMullen, et al., Combination Radial-Axial Magnetic Bearing, Seventh International Symp. on Magnetic Bearings, Aug. 23-25, 2000.

"Design of Electric Machines: Axial Flux Machines," Electric Energy Magazine No. 4, Jan.-Jun. 2013, 23 pages.

Mahmoudi, Rahim and Hew, "Axial-flux permanent-magnet machine modeling, design, simulation and analysis," Scientific Research and Essays vol. 6 (12), Jun. 18, 2011, pp. 2525-2549.

International Search Report of the ISA regarding International Patent Application No. PCT/US2018/017069 dated Jun. 12, 2018.

Written Opinion of the ISA regarding International Patent Application No. PCT/US2018/017069 dated Jun. 12, 2018.

Partial Search Report regarding European Patent Application No. 18155358.7, dated Jun. 27, 2018.

Search Report regarding European Patent Application No. 18155363.7, dated Jul. 2, 2018.

Search Report regarding European Patent Application No. 18155362.9, dated Jul. 2, 2018.

Office Action regarding U.S. Appl. No. 15/425,374, dated Jul. 27, 2018.

Office Action regarding U.S. Appl. No. 15/205,907, dated May 29, 2018.

Notice of Allowance regarding U.S. Appl. No. 15/425,374, dated Nov. 7, 2018.

Notice of Allowance regarding U.S. Appl. No. 15/425,374, dated Nov. 30, 2018.

Office Action regarding U.S. Appl. No. 16/114,912, dated Dec. 3, 2018.

Election Requirement regarding U.S. Appl. No. 15/425,319, dated Jan. 10, 2019.

* cited by examiner

SCROLL COMPRESSOR WITH AXIAL FLUX MOTOR

FIELD

The present disclosure relates to a compressor, and particularly, to a compressor with an axial flux motor, and even more particularly, to a scroll compressor with an axial flux motor.

BACKGROUND

This section provides background information related to the present disclosure and is not necessarily prior art.

A compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Some compressors include a motor assembly that rotates a driveshaft. In this regard, compressors often utilize a motor assembly that includes a stator surrounding a central rotor that is coupled to the driveshaft below the compression mechanism. Regardless of the exact type of compressor employed, consistent and reliable operation of the compressor is desirable to effectively and efficiently circulate the working fluid through the climate control system. The present disclosure provides an improved compressor having a motor assembly that efficiently and effectively drives the compression mechanism while reducing the overall size of the compressor.

SUMMARY

This section provides a general summary of the disclosure, and is not a comprehensive disclosure of its full scope or all of its features.

The present disclosure provides a compressor that may include a first compression member, a second compression member, and a motor assembly. The second compression member is movable relative to the first compression member and cooperates with the first compression member to define a compression pocket therebetween. The motor assembly drives one of the first and second compression members relative to the other one of the first and second compression members. The motor assembly includes a stator and a rotor. The rotor is rotatable relative to the stator about a rotational axis. The stator surrounds the rotational axis. The rotor may include magnets that are arranged around the rotational axis. The magnets may be spaced apart from the stator in an axial direction that is parallel to the first rotational axis.

In some configurations, a magnetic attraction between the stator and the rotor forces the first compression member toward the second compression member in the axial direction.

In some configurations, the first and second compression members are co-rotating first and second scroll members.

In some configurations, the rotor includes a discharge passage that provides fluid communication between the compression pocket and a discharge chamber defined by a shell assembly of the compressor.

In some configurations, the discharge passage includes an axially extending portion through which the rotational axis extends and a radially extending portion that extends radially outward from the axially extending portion.

In some configurations, the radially extending portion includes at least one outlet that directs working fluid toward the stator.

In some configurations, a portion of the rotor is received within a hub of the first scroll member. A first bearing housing may support the hub for rotation.

In some configurations, the rotor includes a radially extending portion and an axially extending portion that extends parallel to the first rotational axis. The axially extending portion may engage the first end plate and surround the second scroll member.

In some configurations, the first compression member includes a non-orbiting scroll member and the second compression member includes an orbiting scroll member. The rotor may be attached to a driveshaft that is drivingly coupled to the orbiting scroll member.

In some configurations, the driveshaft includes a first annular shoulder that contacts the rotor. Magnetic attraction between the stator and the rotor urges the rotor against the first annular shoulder, thereby urging the driveshaft axially toward the orbiting scroll member and urging the orbiting scroll member axially toward the non-orbiting scroll member.

In some configurations, the driveshaft is rotatably supported by a bearing. The orbiting scroll member may be axially supported by a floating thrust plate. The floating thrust plate may be axially supported by the bearing. The bearing may be axially supported by a second annular shoulder formed on the driveshaft. The first and second annular shoulders are axially spaced apart from each other and may be axially spaced apart from an eccentric crank pin of the driveshaft.

The present disclosure also provides a compressor that may include a first scroll member, a second scroll member, a first bearing housing, a second bearing housing, and a motor assembly. The first scroll member includes a first end plate and a first spiral wrap extending from the first end plate. The second scroll member includes a second end plate and a second spiral wrap extending from the second end plate and intermeshed with the first spiral wrap to define compression pockets therebetween. The first bearing housing may support the first scroll member for rotation about a first rotational axis. The second bearing housing may support the second scroll member for rotation about a second rotational axis that is parallel to the first rotational axis and offset from the first rotational axis. The motor assembly includes a stator and a rotor. The stator may surround the first rotational axis and may be fixed relative to the first bearing housing. The rotor may be attached to the first scroll member and may be rotatable with the first scroll member about the first rotational axis. The rotor may include magnets that are arranged around the first rotational axis. The magnets may be spaced apart from the stator in an axial direction that is parallel to the first rotational axis.

In some configurations, a magnetic attraction between the stator and the rotor forces the first scroll member toward the second scroll member in the axial direction.

In some configurations, the rotor includes a discharge passage that provides fluid communication between one of the compression pockets and a discharge chamber defined by a shell assembly of the compressor.

In some configurations, the first rotational axis extends through at least a portion of the discharge passage.

In some configurations, the discharge passage includes an axially extending portion through which the first rotational axis extends and a radially extending portion that extends radially outward from the axially extending portion.

In some configurations, the radially extending portion includes at least one outlet that directs working fluid toward the stator.

In some configurations, a portion of the rotor is received within a hub of the first scroll member. The first bearing housing may support the hub for rotation about the first rotational axis.

In some configurations, the rotor includes a radially extending portion that extends radially relative to the first rotational axis and an axially extending portion that extends parallel to the first rotational axis.

In some configurations, the axially extending portion engages the first end plate and surrounds the second scroll member.

In some configurations, the compressor includes a seal engaging the rotor and the second scroll member. The radially extending portion may engage the seal. The second end plate may be disposed between the first end plate and the radially extending portion in the axial direction.

In some configurations, the floating thrust plate sealingly engages the orbiting scroll member and a bearing housing and cooperates with the orbiting scroll member and the bearing housing to define an annular chamber containing intermediate-pressure working fluid that axially biases the orbiting scroll member toward the non-orbiting scroll member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
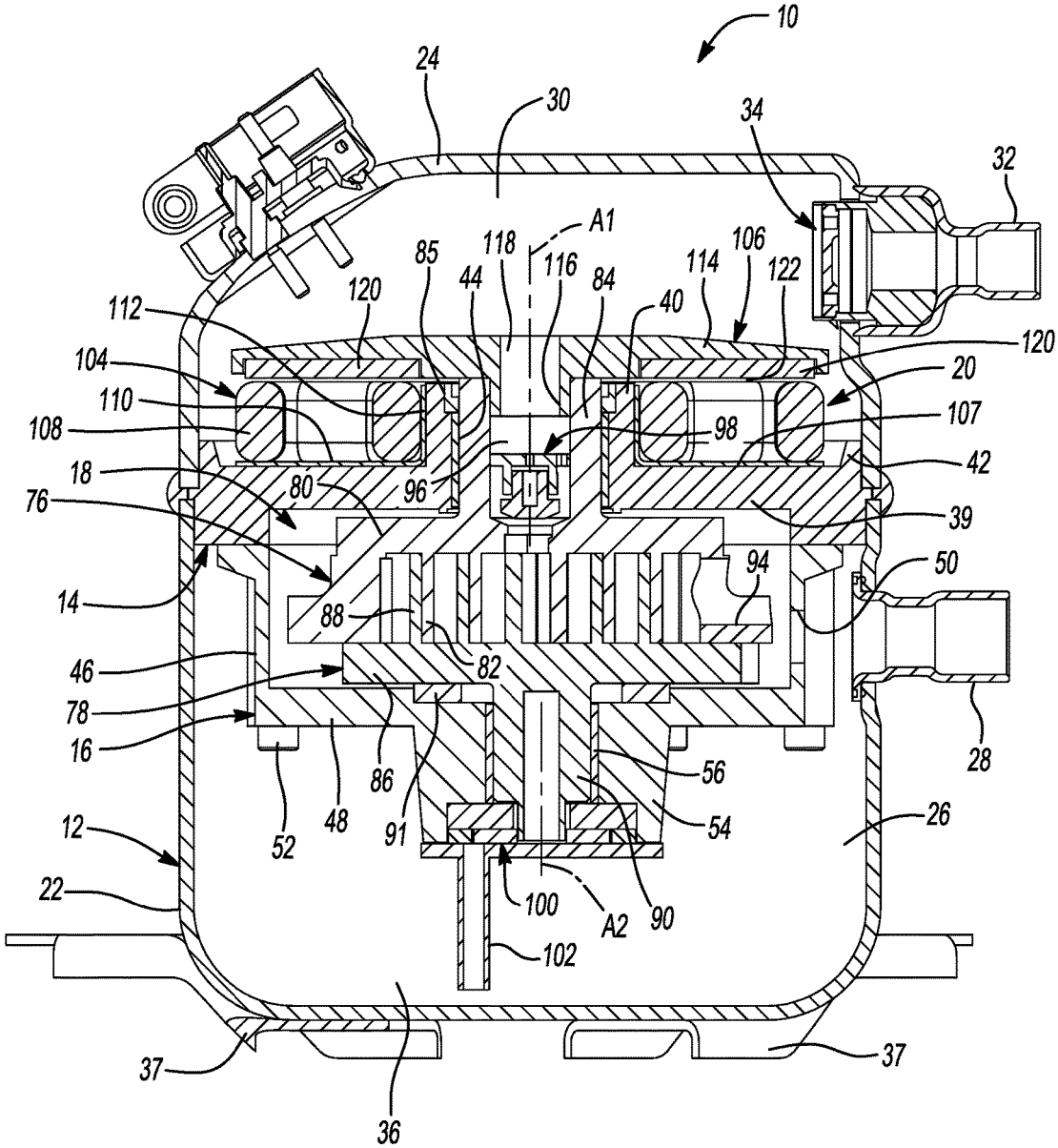
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
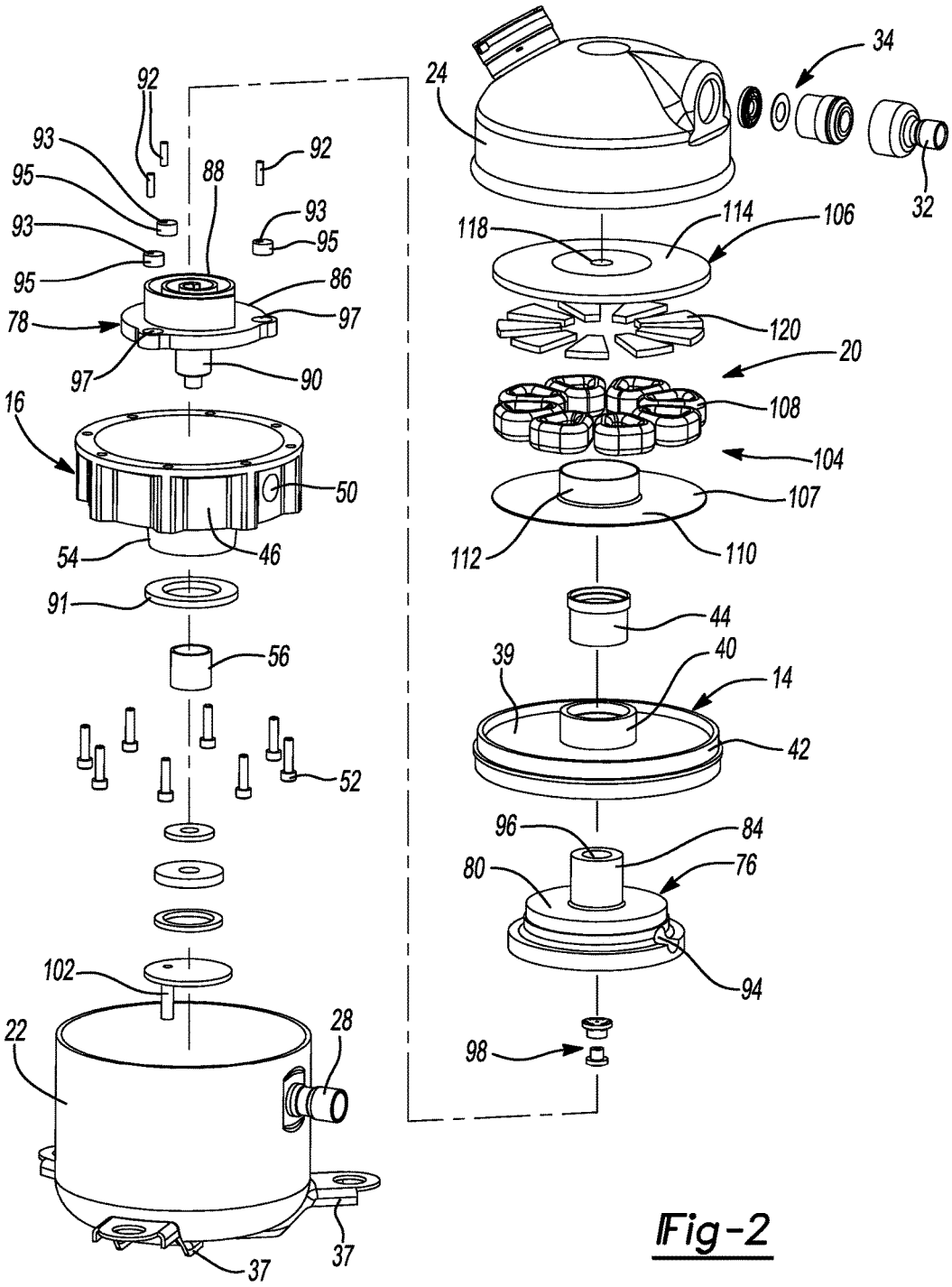
FIG. 2 is an exploded view of the compressor of FIG. 1.

With reference to FIGS. 1 and 2, a compressor 10 is provided that may include a shell assembly 12, a first bearing housing 14, a second bearing housing 16, a compression mechanism 18, and a motor assembly 20. The shell assembly 12 may include a first shell body 22 and a second shell body 24. The first and second shell bodies 22, 24 may be fixed to each other and to the first bearing housing 14. The first shell body 22 and the first bearing housing 14 may cooperate with each other to define a suction chamber 26 in which the second bearing housing 16 and the compression mechanism 18 may be disposed. A suction inlet fitting 28 may engage the first shell body 22 and may be in fluid communication with the suction chamber 26. Suction-pressure working fluid (i.e., low-pressure working fluid) may enter the suction chamber 26 through the suction inlet fitting 28 and may be drawn into the compression mechanism 18 for compression therein. A vertically lower end of the first shell body 22 may define a lubricant sump 36 that contains a volume of lubricant. Mounting feet or flanges 37 may be mounted to an exterior surface of the lower end of the first shell body 22. The compressor 10 may be a low-side compressor (i.e., the compression mechanism 18 is disposed in the suction chamber 26).

The second shell body 24 and the first bearing housing 14 may cooperate with each other to define a discharge chamber 30. The first bearing housing 14 may sealingly engage the first and second shell bodies 22, 24 to separate the discharge chamber 30 from the suction chamber 26. A discharge outlet fitting 32 may engage the second shell body 24 and may be in fluid communication with the discharge chamber 30. Discharge-pressure working fluid (i.e., working fluid at a higher pressure than suction pressure) may enter the discharge chamber 30 from the compression mechanism 18 and may exit the compressor 10 through the discharge outlet fitting 32. In some configurations, a discharge valve 34 may be disposed within the discharge outlet fitting 32. The discharge valve 34 may be a check valve that allows fluid to exit the discharge chamber 30 through the discharge outlet fitting 32 and prevents fluid from entering the discharge chamber 30 through the discharge outlet fitting 32.

The first bearing housing 14 may be a generally disk-shaped member having a main body 39 and a central hub 40 extending axially from the main body 39. The main body 39 may include an outer rim 42 that may be welded to (or otherwise fixedly engaged with) the first and second shell bodies 22, 24. The central hub 40 may receive a first bearing 44. In some configuration, the first bearing housing 14 may include one or more lubricant passages (not shown) through which lubricant from the lubricant sump 36 flows to the first bearing 44.

The second bearing housing 16 may be a generally cylindrical member having an annular wall 46 and a radially extending flange portion 48 disposed at an axial end of the annular wall 46. The annular wall 46 may include one or more openings or apertures 50 through which suction-pressure working fluid in the suction chamber 26 can flow to the compression mechanism 18. An axial end of the annular wall 46 may be attached to the first bearing housing 14 by fasteners 52, for example. The flange portion 48 may include a central hub 54 that receives a second bearing 56. In some configuration, the second bearing housing 16 may include one or more lubricant passages (not shown) through which lubricant from the lubricant sump 36 flows to the second bearing 56.

The compression mechanism 18 may include a first compression member and a second compression member that cooperate to define fluid pockets (i.e., compression pockets) therebetween. For example, the compression mechanism 18 may be a co-rotating scroll compression mechanism in which the first compression member is a first scroll member (i.e., a driven scroll member) 76 and the second compression member is a second scroll member (i.e., an idler scroll member) 78. In other configurations, the compression mechanism 18 could be another type of compression mechanism, such as an orbiting scroll compression mechanism, a rotary compression mechanism, a screw compression mechanism, a Wankel compression mechanism or a reciprocating compression mechanism, for example.

The first scroll member 76 may include a first end plate 80, a first spiral wrap 82 extending from one side of the first end plate 80, and a first hub 84 extending from the opposite side of the first end plate 80. The second scroll member 78 may include a second end plate 86, a second spiral wrap 88 extending from one side of the second end plate 86, and a second hub 90 extending from the opposite side of the second end plate 86. The first hub 84 of the first scroll member 76 is received within the central hub 40 of the first bearing housing 14 and is supported by the first bearing housing 14 and the first bearing 44 for rotation about a first rotational axis A1 relative to the first and second bearing housings 14, 16. A seal 85 is disposed within the central hub 40 and sealing engages the central hub 40 and the first hub 84. The second hub 90 of the second scroll member 78 is received within the central hub 54 of the second bearing housing 16 and is supported by the second bearing housing 16 and the second bearing 56 for rotation about a second rotational axis A2 relative to the first and second bearing housings 14, 16. The second rotational axis A2 is parallel to first rotational axis A1 and is offset from the first rotational axis A1. A thrust bearing 91 may be disposed on the flange portion 48 of the second bearing housing 16 and may axially support the second end plate 86 of the second scroll member 78.

In some configurations, the first compression mechanism 18 could include an Oldham coupling (not shown) that may be keyed to the first and second end plates 80, 86 to transmit motion of the first scroll member 76 to the second scroll member 78. In other configurations, the first compression mechanism 18 may include a transmission mechanism that includes a plurality of pins 92 (FIG. 2) attached to (e.g., by press fit) and extending axially from the first end plate 80 of first scroll member 76. Each of the pins 92 may be received with an off-center aperture 93 in a cylindrical disk 95 (FIG. 2; i.e., an eccentric aperture that extends parallel to and offset from a longitudinal axis of the cylindrical disk 95). The disks 95 may be rotatably received in a corresponding one of a plurality of recesses 97 (FIG. 2) formed in the second end plate 86 of the second scroll member 78. The recesses 97 may be positioned such that they are angularly spaced apart from each other in a circular pattern that surrounds the second rotational axis A2. In this manner, rotation of the first scroll member 76 about the first rotational axis A1 causes corresponding rotation of the second scroll member 78 about the second rotational axis A2, which causes the fluid pockets to decrease in size as they move from a radially outer position to a radially inner position, thereby compressing the working fluid therein from the suction pressure to the discharge pressure.

The first end plate 80 may include a suction inlet opening 94 providing fluid communication between the suction chamber 26 and a radially outermost one of the fluid pockets. The first scroll member 76 also includes a discharge passage 96 that extends through the first end plate 80 and the first hub 84 and provides fluid communication between a radially innermost one of the fluid pockets and the discharge chamber 30. A discharge valve assembly 98 may be disposed within the discharge passage 96. The discharge valve assembly 98 allows working fluid to be discharged from the compression mechanism 18 through the discharge passage 96 into the discharge chamber 30 and prevents working fluid from the discharge chamber 30 from flowing back into to the discharge passage 96.

A lubricant pump 100 may be mounted to the second bearing housing 16 at or adjacent to the central hub 54 that may draw lubricant from the lubricant sump 36 through a lubricant conduit 102 and pump the lubricant to one or more of the bearings 44, 56 and or the scroll members 76, 78 through lubricant passages in the bearing housings 14, 16 and/or the scroll members 76, 78.

The motor assembly 20 may be an axial flux motor including a stator 104 and a rotor 106. In the configuration shown in FIGS. 1 and 2, the motor assembly 20 is disposed within the discharge chamber 30. The stator 104 may include an annular member 107 having a plurality of windings 108 mounted thereto. The annular member 107 may include a disk-shaped main body 110 and a central hub 112 extending axially from the main body 110. The windings 108 may be arranged in a circular pattern that encircles the central hub 112 of the annular member 107.

The stator 104 may be fixedly mounted to the first bearing housing 14. That is, the main body 110 of the annular member 107 may be disposed on and supported by the main body 39 of the first bearing housing 14 such that the main body 39 of the first bearing housing 14 is disposed between the first end plate 80 and the main body 110 of the annular member 107 in a direction extending along or parallel to the first rotational axis A1. The central hub 40 of the first bearing housing 14 may be fixedly received in the central hub 112 of the annular member 107 such that the central hub 112 of the annular member 107 surrounds the central hub 40 of the first bearing housing 14.

The rotor 106 may fixedly engage the first hub 84 of the first scroll member 76 and is rotatable with the first scroll member 76 relative to the stator 104 and the first bearing housing 14. The rotor 106 may include a generally disk-shaped main body 114 and a central hub 116 extending axially from the main body 114. The central hub 116 of the rotor 106 may be fixedly received within the discharge passage 96 defined by the first hub 84 of the first scroll member 76. The rotor 106 may include a discharge passage 118 that extends through the central hub 116 to provide fluid communication between the discharge passage 96 and the discharge chamber 30. The first rotational axis A1 extends through both of the discharge passages 96, 118.

The main body 114 of the rotor 106 extends radially outward from the central hub 116 and is axially spaced apart (i.e., spaced apart in a direction extending along or parallel to the first rotational axis A1) from the first bearing housing 14 and the stator 104. The rotor 106 may include a plurality of magnets 120 that are fixedly attached to the main body 114 such that the magnets 120 are axially spaced apart (i.e., spaced apart in a direction extending along or parallel to the first rotational axis A1) from the stator 104 such that an air gap 122 is disposed axially between the magnets 120 and the windings 108. In other words, the entire stator 104 may be disposed axially between (i.e., in a direction along or parallel to the first rotational axis A1) the main body 39 of the first bearing housing 14 and the magnets 120.

During operation of the compressor 10, electrical current may be supplied to the windings 108 of the stator 104, which causes rotation of the rotor 106 (and thus, the first scroll member 76) relative to the stator 104 and the first bearing housing 14. A magnetic flux through the air gap 122 between the magnets 120 and the windings 108 in an axial direction parallel to the first rotational axis A1 creates a magnetic attraction between the magnets 120 and the windings 108 that forces the rotor 106 toward the stator 104 in an axial direction (i.e., a direction along or parallel to the first rotational axis A1). This axial magnetic force (along with the force of discharge-pressure working fluid in the discharge chamber 30) biases the rotor 106 and the first scroll member 76 axially toward the second scroll member 78. Such axial biasing of the first scroll member 76 toward the second scroll member 78 maintains a sealed relationship between the tips of the first spiral wrap 82 and the second end plate 86 and between the tips of the second spiral wrap 88 and the first end plate 80, thereby preventing leakage between the wraps 82, 88 and end plates 86, 80. Furthermore, such axial biasing also helps to keep the scroll members 76, 78 loaded at startup of the compressor 10, which increases discharge pressure at startup.

Since the axial magnetic attraction between rotor 106 and the stator 104 axially biases the scroll members 76, 78 together, the compressor 10 may not need to include a floating seal assembly and axial biasing chamber that are commonly employed in prior-art compressors to axially bias one scroll member toward the other scroll member.

Furthermore, the configuration of the motor assembly 20 described above and shown in the figures allows the motor assembly 20 to be more compact in the axial direction, which allows the overall axial height of the compressor 10 to be significantly reduced.

Figure 3:
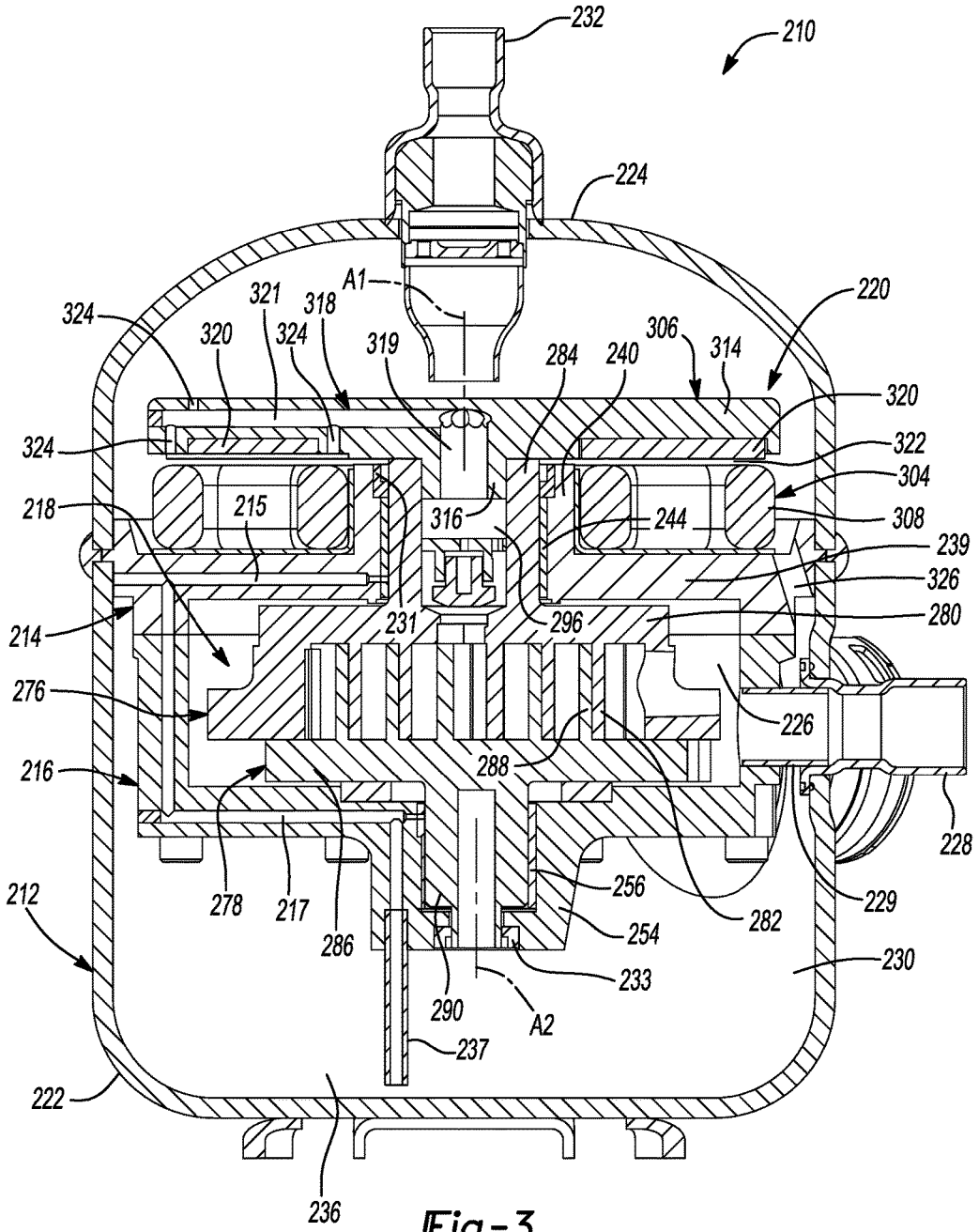
FIG. 3 is a cross-sectional view of another compressor according to the principles of the present disclosure.

With reference to FIG. 3, another compressor 210 is provided that may include a shell assembly 212, a first bearing housing 214, a second bearing housing 216, a compression mechanism 218, and a motor assembly 220. The structure and function of the shell assembly 212, first bearing housing 214, second bearing housing 216, compression mechanism 218, and motor assembly 220 may be similar or identical to that of the shell assembly 12, first bearing housing 14, second bearing housing 16, compression mechanism 18, and motor assembly 20 described above, apart from any exceptions described below. Therefore, some similar features will not be described again in detail.

The shell assembly 212 may include first and second shell bodies 222, 224. The compressor 210 is a high-side compressor—i.e., the first and second shell bodies 222, 224 cooperate to define a discharge chamber 230 in which the bearing housings 214, 216 and the motor assembly 220 are disposed. A discharge outlet fitting 232 may extend through the second shell body 224 and may be in fluid communication with the discharge chamber 230. A suction inlet fitting 228 may extend through the first shell body 222 and may provide suction-pressure working fluid to the compression mechanism 218. The suction inlet fitting 228 is fluidly isolated from the discharge chamber 230.

The first and second bearing housings 214, 216 may cooperate to define a suction chamber 226 that is in fluid communication with the suction inlet fitting 228 (via a suction conduit 229) and is sealed off from the discharge chamber 230. A majority of the compression mechanism 218 may be disposed within the suction chamber 226. The discharge chamber 230 may surround the suction chamber 226. A first annular seal 231 may sealingly engage a central hub 240 of the first bearing housing 214 and a first hub 284 of the first scroll member 276. A second annular seal 233 may sealingly engage a central hub 254 of the second bearing housing 216 and a second hub 290 of the second scroll member 278. In this manner, the seals 231, 233 seal off the suction chamber 226 from the discharge chamber 230.

The first and second bearing housings 214, 216 may include lubricant passages 215, 217 that are in fluid communication with each other and a lubricant sump 236 defined by the first shell body 222. Relatively high-pressure working fluid in the discharge chamber 230 may force lubricant through a lubricant conduit 237 and through the lubricant passages 215, 217 to first and second bearings 244, 256 and the compression mechanism 218.

Like the compression mechanism 18, the compression mechanism 218 may include a first scroll member 276 and a second scroll member 278. The compression mechanism 218 may be a co-rotating scroll compression mechanism. That is, the first scroll member 276 may rotate about a first rotational axis A1 and the second scroll member 278 may rotate about a second rotational axis A2 that is parallel to and offset from the first rotational axis. As described above, an Oldham coupling or other transmission mechanism may be employed to transmit motion of the first scroll member 276 to the second scroll member 278.

Like the motor assembly 20, the motor assembly 220 may be an axial flux motor including a stator 304 and a rotor 306. The stator 304 may be similar or identical to the stator 104 and may be mounted to the first bearing housing 214 in the same or similar manner as described above with respect to the stator 104.

The rotor 306 may fixedly engage the first hub 284 of the first scroll member 276 and is rotatable with the first scroll member 276 relative to the stator 304 and the first bearing housing 214. The rotor 306 may include a generally disk-shaped main body 314 and a central hub 316 extending axially from the main body 314. The central hub 316 of the rotor 306 may be fixedly received within a discharge passage 296 defined by the first hub 284 of the first scroll member 276. The rotor 306 may include a discharge passage 318 that extends through the central hub 316 to provide fluid communication between the discharge passage 296 and the discharge chamber 230. The discharge passage 318 may include an axially extending portion 319 and a radially extending portion 321. The first rotational axis A1 extends through the discharge passage 296 and the axially extending portion 319 of the discharge passage 318. The radially extending portion 321 may extend radially outward from the axially extending portion 319. The radially extending portion 321 may include one or more outlets 324 in fluid communication with the discharge chamber 230.

The main body 314 of the rotor 306 extends radially outward from the central hub 316 and is axially spaced apart (i.e., spaced apart in a direction extending along or parallel to the first rotational axis A1) from the first bearing housing 214 and the stator 304. The rotor 306 may include a plurality of magnets 320 that are fixedly attached to the main body 314 such that the magnets 320 are axially spaced apart (i.e., spaced apart in a direction extending along or parallel to the first rotational axis A1) from the stator 304 such that an air gap 322 is disposed axially between the magnets 320 and windings 308 of the stator 304. In other words, the entire stator 304 may be disposed axially between (i.e., in a direction along or parallel to the first rotational axis A1) a main body 239 of the first bearing housing 214 and the magnets 320.

As described above, during operation of the compressor 210, electrical current may be supplied to the windings 308 of the stator 304, which causes rotation of the rotor 306 (and thus, the first scroll member 276) relative to the stator 304 and the first bearing housing 214. A magnetic flux through the air gap 322 between the magnets 320 and the windings 308 in an axial direction parallel to the first rotational axis A1 creates a magnetic attraction between the magnets 320 and the windings 308 that forces the rotor 306 toward the stator 304 in an axial direction (i.e., a direction along or parallel to the first rotational axis A1). This axial magnetic force (along with the force of discharge-pressure working fluid in the discharge chamber 230) biases the rotor 306 and the first scroll member 276 axially toward the second scroll member 278. Such axial biasing of the first scroll member 276 toward the second scroll member 278 maintains a sealed relationship between tips of first spiral wrap 282 and second end plate 286 and between the tips of second spiral wrap 288 and first end plate 280, thereby preventing leakage between the wraps 282, 288 and end plates 286, 280. Furthermore, such axial biasing also helps to keep the scroll members 276, 278 loaded at startup of the compressor 210, which increases discharge pressure at startup.

Since the axial magnetic attraction between rotor 306 and the stator 304 axially biases the scroll members 276, 278 together, the compressor 210 may not need to include a floating seal assembly and axial biasing chamber that are commonly employed in prior-art compressors to axially bias one scroll member toward the other scroll member.

Furthermore, the configuration of the motor assembly 220 described above and shown in the figures allows the motor assembly 220 to be more compact in the axial direction, which allows the overall axial height of the compressor 210 to be significantly reduced.

Furthermore, during operation of the compressor 210, working fluid may flow from the discharge passage 296 of the first scroll member 276 to the discharge passage 318 in the rotor 306. That is, the working fluid may flow from the discharge passage 296 to the axially extending portion 319 of the discharge passage 318 and then through the radially extending portion 321 and the outlets 324. One or more of the outlets 324 may be oriented adjacent the stator 304 such that working fluid exiting the discharge passage 318 through such outlet(s) 324 is directed toward the stator 304 so that the working fluid (and lubricant entrained in the working fluid) can cool the stator 304 before the working fluid exits the compressor 210 through the discharge outlet fitting 232.

Lubricant that is entrained in the working fluid may separate from the working fluid when the working fluid flows across and through the stator 304. Furthermore, centrifugal force due to rotation of the rotor 306 may also separate lubricant from the working fluid as the mixture of working fluid and lubricant is flung radially outward from the outlets 324 against the inner wall of the second shell body 224. Separated lubricant may drain back to the lubricant sump 236 through one or more drain apertures 326 in the first bearing housing 214.

Figure 4:
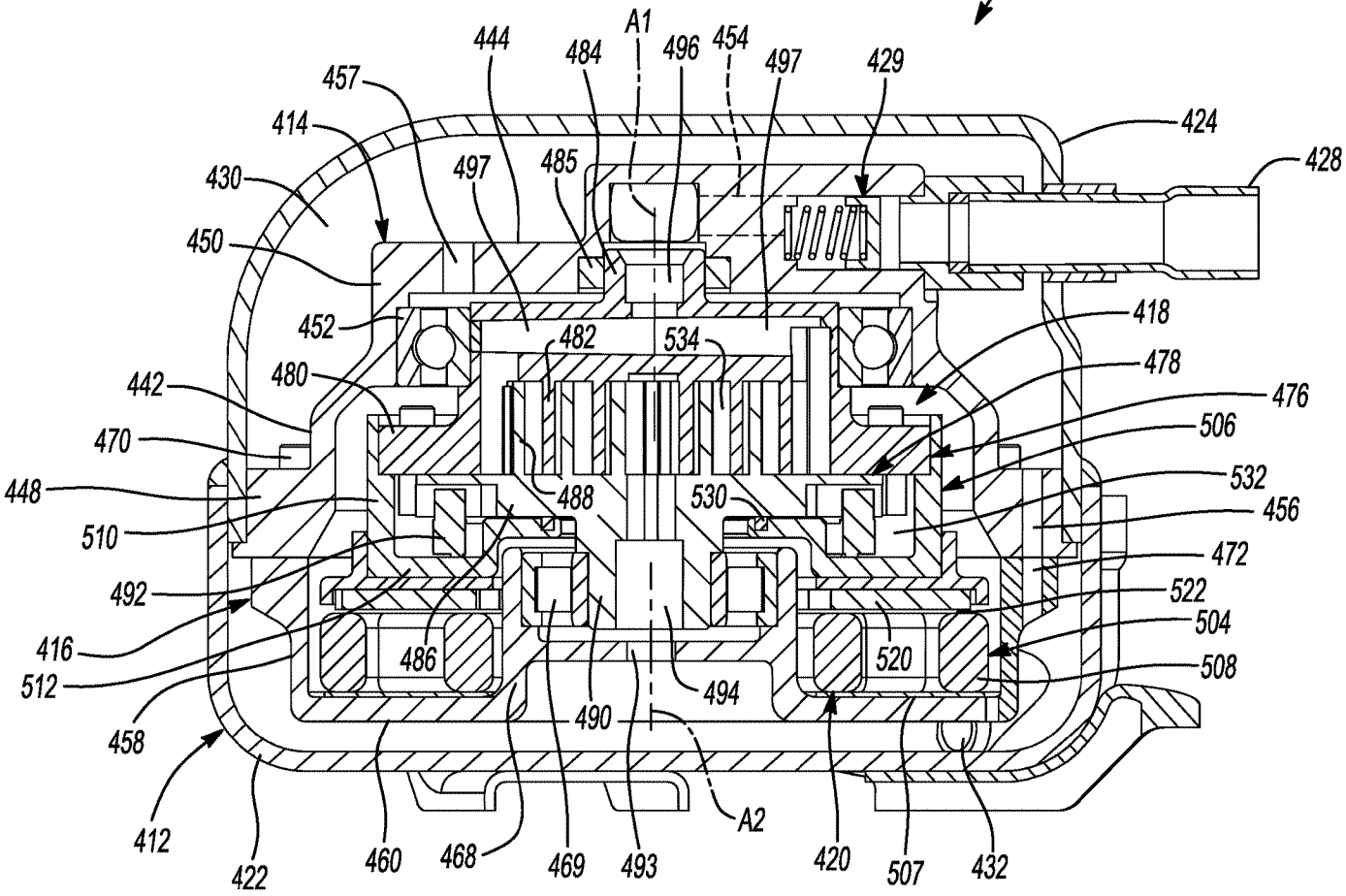
FIG. 4 is a cross-sectional view of yet another compressor according to the principles of the present disclosure.

With reference to FIG. 4, another compressor 410 is provided that may include a shell assembly 412, a first bearing housing 414, a second bearing housing 416, a compression mechanism 418, and a motor assembly 420. The compressor 410 may be a high-side sumpless compressor (i.e., the first bearing housing 414, second bearing housing 416, compression mechanism 418, and motor assembly 420 may be disposed within a discharge chamber 430 defined by the shell assembly 412; and the compressor 410 does not include a lubricant sump).

The shell assembly 412 may include a first shell body 422 and a second shell body 424 that is fixed to the first shell body 422 (e.g., via welding, press fit, etc.). The first and second shell bodies 422, 424 may cooperate with each other to define the discharge chamber 430. A suction inlet fitting 428 may extend through the second shell body 424. A discharge outlet fitting 432 may engage the first shell body 422 and may be in fluid communication with the discharge chamber 430. In some configurations, a discharge valve (e.g., a check valve) may be disposed within the discharge outlet fitting 432.

The first bearing housing 414 may include an annular wall 442 and a radially extending flange portion 444 disposed at an axial end of the annular wall 442. The annular wall 442 may include an outer rim 448 that may be fixed to the second shell body 424. The flange portion 444 may include a central hub 450 that receives a first bearing 452 (e.g., a roller bearing). The central hub 450 may define a suction passage 454 that is fluidly coupled with the suction inlet fitting 428. The compression mechanism 418 may draw suction-pressure working fluid from the suction inlet fitting 428 through the suction passage 454. A suction valve assembly 429 (e.g., a check valve) may be disposed within the suction passage 454. The suction valve assembly 429 allows suction-pressure working fluid to flow through the suction passage 454 toward the compression mechanism 418 and prevents the flow of working fluid in the opposite direction. The first bearing housing 414 may include passages 456 that extend through the annular wall 442 and one or more passages 457 that extend through the flange portion 444 to allow lubricant and working fluid discharged from the compression mechanism 418 to circulate throughout the shell assembly 412 to cool and lubricate moving parts of the compressor 410.

The second bearing housing 416 may include an annular wall 458, a central hub 468, and a flange portion 460 that extends radially between the annular wall 458 and the central hub 468. The central hub 468 may receive a second bearing 469 (e.g., a roller bearing). The annular wall 458 of the second bearing housing 416 may be fixedly attached to an axial end of the annular wall 442 of the first bearing housing 414 via a plurality of fasteners 470, for example. Passages 472 may extend through the second bearing housing 416 and may be in fluid communication with the passages 456 in the first bearing housing 414 to allow working fluid and lubricant to circulate throughout the shell assembly 412.

The compression mechanism 418 may include a first compression member and a second compression member that cooperate to define fluid pockets (i.e., compression pockets) therebetween. For example, the compression mechanism 418 may be a co-rotating scroll compression mechanism in which the first compression member is a first scroll member (i.e., a driven scroll member) 476 and the second compression member is a second scroll member (i.e., an idler scroll member) 478. The first scroll member 476 may include a first end plate 480, a first spiral wrap 482 extending from one side of the first end plate 480, and a first hub 484 extending from the opposite side of the first end plate 480. The second scroll member 478 may include a second end plate 486, a second spiral wrap 488 extending from one side of the second end plate 486, and a second hub 490 extending from the opposite side of the second end plate 486.

The first hub 484 of the first scroll member 476 is received within the central hub 450 of the first bearing housing 414. A seal 485 is disposed within the central hub 450 and sealing engages the central hub 450 and the first hub 484. A portion of the first end plate 480 is also received within the central hub 450 and is supported by the first bearing housing 414 and the first bearing 452 for rotation about a first rotational axis A1 relative to the first and second bearing housings 414, 416. The second hub 490 of the second scroll member 478 is received within the central hub 468 of the second bearing housing 416 and is supported by the second bearing housing 416 and the second bearing 469 for rotation about a second rotational axis A2 relative to the first and second bearing housings 414, 416. The second rotational axis A2 is parallel to first rotational axis A1 and is offset from the first rotational axis A1.

An Oldham coupling 492 may be keyed to the second end plate 486 and a rotor 506 of the motor assembly 420. In some configurations, the Oldham coupling 492 could be keyed to the first and second end plates 480, 486. The first and second spiral wraps 482, 488 are intermeshed with each other and cooperate to form a plurality of fluid pockets (i.e., compression pockets) therebetween. Rotation of the first scroll member 476 about the first rotational axis A1 and rotation of the second scroll member 478 about the second rotational axis A2 causes the fluid pockets to decrease in size as they move from a radially outer position to a radially inner position, thereby compressing the working fluid therein from the suction pressure to the discharge pressure.

The first scroll member 476 may include an axially extending suction passage 496 that extends through the first hub 484 and into the first end plate 480. Radially extending suction passages 497 formed in the first end plate 480 extend radially outward from the axially extending suction passage 496 and provide fluid communication between the axially extending suction passage 496 and radially outermost fluid pockets. Accordingly, during operation of the compressor 410, suction-pressure working fluid can be drawn into the suction inlet fitting 428, through the suction passage 454 of the first bearing housing 414, through the axially extending suction passage 496, and then through the radially extending suction passages 497 to the radially outermost fluid pockets defined by the spiral wraps 482, 488.

The second scroll member 478 may include one or more discharge passages 494 that extend through the second end plate 486 and the second hub 490 and provide fluid communication between a radially innermost one of the fluid pockets and the discharge chamber 430. The second bearing housing 416 may include one or more discharge openings 493 providing fluid communication between the discharge passage 494 and the discharge chamber 430.

The motor assembly 420 may be an axial flux motor including a stator 504 and the rotor 506. The stator 504 may include a generally disk-shaped annular member 507 having a plurality of windings 508 fixedly mounted thereto. The annular member 507 may be fixedly mounted on the flange portion 460 of the second bearing housing 416 such that the stator 504 is disposed radially between the annular wall 458 of the second bearing housing 416 and the central hub 468 of the second bearing housing 416.

The rotor 506 may fixedly engage the first end plate 480 of the first scroll member 476 and is rotatable with the first scroll member 476 relative to the stator 504 and the first bearing housing 414. The rotor 506 may include an annular axially extending portion 510 and a radially extending portion 512. The axially extending portion 510 may surround the first and second end plates 480, 486 and the first and second spiral wraps 482, 488. The axially extending portion 510 may fixedly engage an outer periphery of the first end plate 480 such that when electrical current is provided to the stator 504, the rotor 506 and the first scroll member 476 rotate together about the first rotational axis A1.

The radially extending portion 512 of the rotor 506 extends radially from an axial end of the axially extending portion 510 and is axially spaced apart (i.e., spaced apart in a direction extending along or parallel to the first rotational axis A1) from the stator 504. The rotor 506 may include a plurality of magnets 520 that are fixedly attached to the radially extending portion 512 such that the magnets 520 are axially spaced apart (i.e., spaced apart in a direction extending along or parallel to the first rotational axis A1) from the stator 504 such that an air gap 522 is disposed axially between the magnets 520 and the windings 508. In other words, the entire stator 504 may be disposed axially below the magnets 520 (i.e., in a direction along or parallel to the first rotational axis A1) or axially between the flange portion 460 of the second bearing housing 416 and the magnets 520.

During operation of the compressor 410, electrical current may be supplied to the windings 508 of the stator 504, which causes rotation of the rotor 506 (and thus, the first scroll member 476) relative to the stator 504 and the first bearing housing 414. A magnetic flux through the air gap 522 between the magnets 520 and the windings 508 in an axial direction parallel to the first rotational axis A1 creates a magnetic attraction between the magnets 520 and the windings 508 that forces the rotor 506 toward the stator 504 in an axial direction (i.e., a direction along or parallel to the first rotational axis A1), thereby pulling the first scroll member 476 axially toward the second scroll member 478. Such axial biasing of the first scroll member 476 toward the second scroll member 478 maintains a sealed relationship between the tips of the first spiral wrap 482 and the second end plate 486 and between the tips of the second spiral wrap 488 and the first end plate 480, thereby preventing leakage between the wraps 482, 488 and end plates 486, 480. Furthermore, such axial biasing also helps to keep the scroll members 476, 478 loaded at startup of the compressor 410, which increases discharge pressure at startup.

Furthermore, the configuration of the motor assembly 420 described above and shown in the figures allows the motor assembly 420 to be more compact in the axial direction, which allows the overall axial height of the compressor 410 to be significantly reduced.

In some configurations, an annular seal 530 may be received in a recess in the radially extending portion 512 of the rotor 506 and may sealingly engage the radially extending portion 512 and the second end plate 486. The annular seal 530, the first and second end plates 480, 486 and the radially extending portion 512 cooperate to define an annular chamber 532. The annular chamber 532 may receive intermediate-pressure working fluid (at a pressure greater than suction pressure and less than discharge pressure) from an intermediate fluid pocket 534 via a passage (not shown) in the second end plate 486. Intermediate-pressure working fluid in the annular chamber 532 biases the second end plate 486 in an axial direction (i.e., a direction parallel to the rotational axes A1, A2) toward the first end plate 480 to assist in sealing the tips of spiral wraps 482, 488 with the end plates 486, 480.

Figure 5:
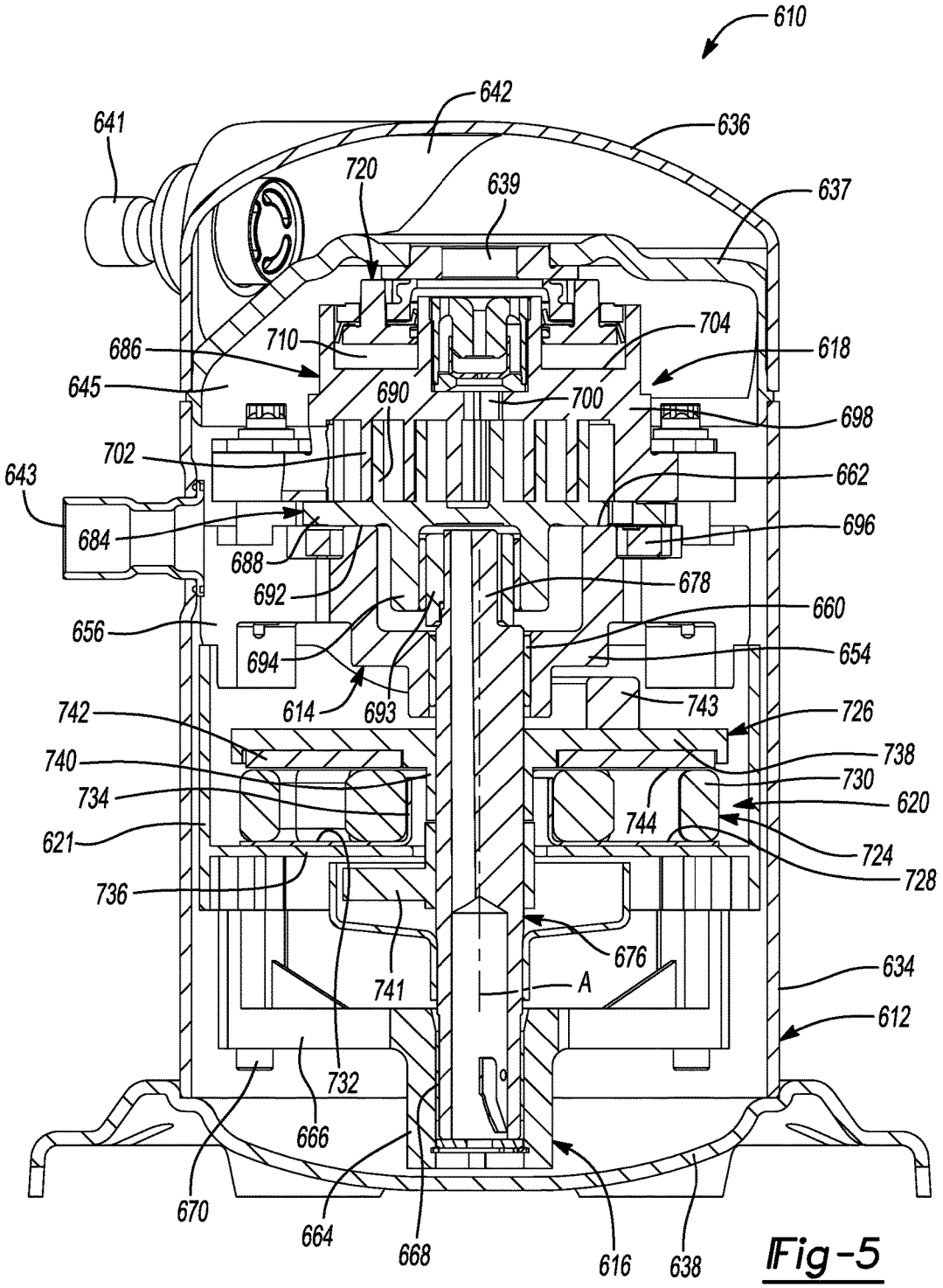
FIG. 5 is a cross-sectional view of yet another compressor according to the principles of the present disclosure.

With reference to FIG. 5, another compressor 610 is provided that may include a shell assembly 612, a first bearing housing 614, a second bearing housing 616, a compression mechanism 618, and a motor assembly 620. The shell assembly 612 may include a generally cylindrical shell body 634, an end cap 636, a transversely extending partition plate 637, and a base 638. The end cap 636 may be fixed to an upper end of the shell body 634. The base 638 may be fixed to a lower end of the shell body 634. The end cap 636 and partition plate 637 may define a discharge chamber 642 therebetween that receives compressed working fluid from the compression mechanism 618. The partition plate 637 may include an opening 639 providing communication between the compression mechanism 618 and the discharge chamber 642. A discharge outlet fitting 641 may be attached to the end cap 636 and is in fluid communication with the discharge chamber 642. A suction inlet fitting 643 may be attached to the shell body 634 and may be in fluid communication with a suction chamber 645. The partition plate 637 separates the discharge chamber 642 from the suction chamber 645.

The first bearing housing 614 may include a central body 654 and arms 656 extending radially outward from the central body 654. The arms 656 may be fixed to the shell body 634 via staking or press fit, for example. The central body 654 receives a first bearing 660. The central body 654 may include a thrust bearing surface 662 that axially supports the compression mechanism 618. The second bearing housing 616 may include a central body 664 and arms 666 extending radially outward therefrom. The central body 664 receives a second bearing 668. The arms 666 of the second bearing housing 616 may be attached to a stator housing 621 of the motor assembly 620 via fasteners 670, for example. The second bearing housing 616 may be free from contact with the shell assembly 612. The stator housing 621 may be attached to the first bearing housing 614 via fasteners, press fit, welding, staking, etc. The first and second bearings 660, 668 and the first and second bearing housings 614, 616 may rotatably support a driveshaft 676 that is driven by the motor assembly 620 and drives the compression mechanism 618.

The compression mechanism 618 may include a first compression member and a second compression member that cooperate to define fluid pockets (i.e., compression pockets) therebetween. For example, the compression mechanism 618 may be an orbital scroll compression mechanism in which the first compression member may be an orbiting scroll member 684 and the second compression member may be a non-orbiting scroll member 686 meshingly engaged with the orbiting scroll member 684. The orbiting scroll member 684 may include an end plate 688 having a spiral wrap 690 on the upper surface thereof and an annular flat thrust surface 692 on the lower surface. The thrust surface 692 may interface with the thrust bearing surface 662 on the first bearing housing 614. A cylindrical hub 694 may project downwardly from the thrust surface 692 and may have a drive bushing 693 rotatably disposed therein. The drive bushing 693 may include an inner bore receiving an eccentric crank pin 678 of the driveshaft 676. A flat surface of the crank pin 678 may drivingly engage a flat surface in a portion of the inner bore of the drive bushing 693 to provide a radially compliant driving arrangement. An Oldham coupling 696 may be engaged with the orbiting scroll member 684 and the first bearing housing 614 (or with the orbiting and non-orbiting scrolls 684, 686) to prevent relative rotation between the orbiting and non-orbiting scrolls 684, 686.

The non-orbiting scroll member 686 may include an end plate 698 defining a discharge passage 700 and having a spiral wrap 702 extending from a first side thereof and an annular recess 704 defined in a second side thereof opposite the first side. The end plate 698 may be attached to the first bearing housing 614 by fasteners and bushings to allow limited axial movement of the non-orbiting scroll member 686 relative to the first bearing housing 614. The end plate 698 may additionally include a biasing passage (not shown) in fluid communication with the annular recess 704 and an intermediate compression pocket defined by the orbiting and non-orbiting scrolls 684, 686. A floating seal assembly 720 may be partially received in the annular recess 704 and may be sealingly engaged with the non-orbiting scroll member 686 to define an axial biasing chamber 710 containing intermediate-pressure working fluid that biases the non-orbiting scroll member 686 axially (i.e., in a direction parallel to the rotational axis A of the drive shaft 676) toward the orbiting scroll member 684.

The motor assembly 620 may be an axial flux motor including the stator housing 621, a stator 724 and a rotor 726. The stator 724 may include an annular member 728 having a plurality of windings 730 mounted thereto. The annular member 728 may include a disk-shaped main body 732 and a central hub 734 extending axially from the main body 732. The windings 730 may be arranged in a circular pattern that encircles the central hub 734 of the annular member 728. The stator 724 may be fixedly mounted to the stator housing 621. For example, the main body 732 of the annular member 728 may be disposed on and supported by a radially extending flange 736 of the stator housing 621.

The rotor 726 may fixedly engage the driveshaft 676 and is rotatable with the driveshaft 676 relative to the stator 724, the bearing housings 614, 616, and the stator housing 621. The rotor 726 may include a generally disk-shaped main body 738 and a central hub 740 extending axially from the main body 738. The central hub 740 of the rotor 726 may fixedly receive the driveshaft 676 via press fit, for example. A lower counterweight 741 may be attached to the driveshaft 676 at any suitable location, such as a location axially between the central hub 740 and the second bearing 668. An upper counterweight 743 may be attached to the main body 738 of the rotor 726.

The main body 738 of the rotor 726 extends radially outward from the central hub 740 and is axially spaced apart (i.e., spaced apart in a direction extending along or parallel to the rotational axis A of the driveshaft) from the stator 724. The rotor 726 may include a plurality of magnets 742 that are fixedly attached to the main body 738 such that the magnets 742 are axially spaced apart (i.e., spaced apart in a direction extending along or parallel to the rotational axis A) from the stator 724 such that an air gap 744 is disposed axially between the magnets 742 and the windings 730. In other words, the entire stator 724 may be disposed axially between (i.e., in a direction along or parallel to the rotational axis A) the flange 736 of the stator housing 621 and the magnets 742.

The axially compact configuration of the motor assembly 620 allows for the driveshaft 676 to be shorter, which reduces vibration during operation of the compressor 610. Furthermore, the configuration of the bearing housings 614, 616 and the stator housing 621—i.e., all of the compressor components being mounted to the first bearing housing 614, which is then mounted to the shell assembly 612—allows for complete assembly of the compressor components outside of the shell assembly 612 so that the compressor components can be fully aligned and tested prior to being installed and sealed within the shell assembly 612. Therefore, if any adjustments to the assembly need to be performed after testing, the shell assembly 612 does not have to be opened (e.g., cut open or unsealed) to access the components that need to be adjusted.

Figure 6:
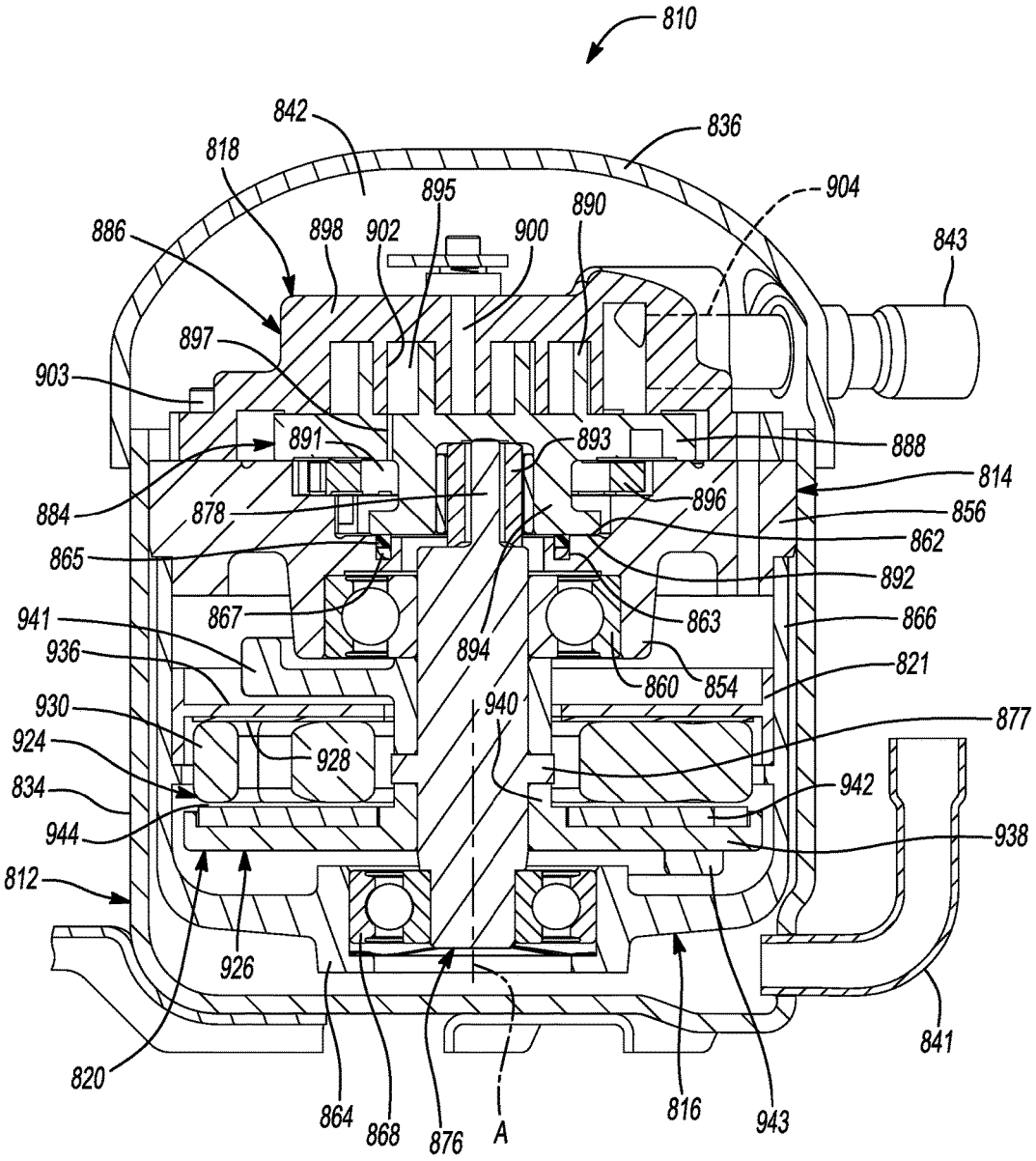
FIG. 6 is a cross-sectional view of yet another compressor according to the principles of the present disclosure.

With reference to FIG. 6, another compressor 810 is provided that may include a shell assembly 812, a first bearing housing 814, a second bearing housing 816, a compression mechanism 818, and a motor assembly 820. The shell assembly 812 may include a generally cylindrical lower shell body 834 and an end cap 836. The end cap 836 may be fixed to an upper end of the shell body 834. The end cap 836 and the shell body 834 may define a discharge chamber 842 that receives compressed working fluid from the compression mechanism 818. A discharge outlet fitting 841 may be attached to the shell body 834 and is in fluid communication with the discharge chamber 842. A suction inlet fitting 843 may be attached to the end cap 836 and may provide suction-pressure working fluid to the compression mechanism 818. The suction inlet fitting 843 may be fluidly isolated from the discharge chamber 842. The compressor 810 is a high-side sumpless compressor (i.e., the first bearing housing 814, second bearing housing 816, compression mechanism 818, and motor assembly 820 may be disposed within the discharge chamber 842; and the compressor 810 does not include a lubricant sump).

The first bearing housing 814 may include a central body 854 and arms 856 extending radially outward from the central body 854. The arms 856 may be fixed to the shell body 834 via staking or press fit, for example. The central body 854 receives a first bearing 860 (e.g., a roller bearing). The central body 854 may include an annular surface 862 including an annular groove 863 that receives an annular seal 865 and an annular spring 867. The second bearing housing 816 may include a central hub 864 and an annular wall 866 extending radially outward and axially upward therefrom. The central hub 864 receives a second bearing 868 (e.g., a roller bearing). The annular wall 866 of the second bearing housing 816 may be attached to the arms 856 of the first bearing housing 814 and to a stator housing 821 of the motor assembly 820 via fastener or press fit, for example. The second bearing housing 816 may be free from contact with the shell assembly 812. The first and second bearings 860, 868 and the first and second bearing housings 814, 816 may rotatably support a driveshaft 876 that is driven by the motor assembly 820 and drives the compression mechanism 818.

The compression mechanism 818 may include a first compression member and a second compression member that cooperate to define fluid pockets (i.e., compression pockets) therebetween. For example, the compression mechanism 818 may be an orbital scroll compression mechanism in which the first compression member may be an orbiting scroll member 884 and the second compression member may be a non-orbiting scroll member 886 meshingly engaged with the orbiting scroll member 884. The orbiting scroll member 884 may include an end plate 888 having a spiral wrap 890 on the upper surface thereof and an annular hub 894 extending from the lower surface of the end plate 888. The lower axial end of the annular hub 894 may include an annular flat surface 892. The annular seal 865 may sealingly engage the surface 892 to define an annular intermediate-pressure chamber 891. The annular spring 867 biases the annular seal 865 into sealing engagement with the surface 892. The intermediate-pressure chamber 891 may receive intermediate-pressure working fluid from an intermediate-pressure compression pocket 895 via an aperture 897 extending through the end plate 888. Intermediate-pressure working fluid in the intermediate-pressure chamber 891 axially supports the orbiting scroll member 884 during operation of the compression mechanism 818 and allows the orbiting scroll member 884 to axially float relative to the first bearing housing 814. The annular surface 862 of the first bearing housing 814 may act as a stop surface that limits the range of axial movement of the orbiting scroll member 884 (e.g., during a liquid-flooding condition where liquid working fluid is present in the compression pockets).

A drive bushing 893 may be rotatably disposed within the annular hub 894. The drive bushing 893 may include an inner bore receiving an eccentric crank pin 878 of the driveshaft 876. A flat surface of the crank pin 878 may drivingly engage a flat surface in a portion of the inner bore of the drive bushing 893 to provide a radially compliant driving arrangement. An Oldham coupling 896 may be engaged with the orbiting scroll member 884 and the first bearing housing 814 (or with the orbiting and non-orbiting scrolls 884, 886) to prevent relative rotation between the orbiting and non-orbiting scrolls 884, 886.

The non-orbiting scroll member 886 may include an end plate 898 defining a discharge passage 900 and having a spiral wrap 902 extending from the end plate 898. The end plate 898 may be attached to the first bearing housing 814 by fasteners 903. The end plate 898 may also include a suction passage 904 fluidly coupled with the suction inlet fitting 843 and providing suction-pressure working fluid to the compression pockets.

The motor assembly 820 may be an axial flux motor including the stator housing 821, a stator 924 and a rotor 926. The stator 924 may include an annular disk-shaped member 928 having a plurality of windings 930 mounted thereto. The windings 930 may be arranged in a circular pattern that encircles the driveshaft 876. The stator 924 may be fixedly mounted to the stator housing 821. For example, the disk-shaped member 928 may be mounted to a radially extending flange 936 of the stator housing 821.

The rotor 926 may fixedly engage the driveshaft 876 and is rotatable with the driveshaft 876 relative to the stator 924, the bearing housings 814, 816, and the stator housing 821. The rotor 926 may include a generally disk-shaped main body 938 and a central hub 940 extending axially from the main body 938. The central hub 940 of the rotor 926 may fixedly receive the driveshaft 876 via press fit, for example. An axial end of the central hub 940 may abut a radially extending annular shoulder 877 formed on the driveshaft 876. An upper counterweight 941 may be attached to the driveshaft 876 at any suitable location, such as a location axially between the annular shoulder 877 and the first bearing 860. A lower counterweight 943 may be attached to the main body 938 of the rotor 926.

The main body 938 of the rotor 926 extends radially outward from the central hub 940 and is axially spaced apart (i.e., spaced apart in a direction extending along or parallel to the rotational axis A of the driveshaft 876) from the stator 924. The rotor 926 may include a plurality of magnets 942 that are fixedly attached to the main body 938 such that the magnets 942 are axially spaced apart (i.e., spaced apart in a direction extending along or parallel to the rotational axis A) from the stator 924 such that an air gap 944 is disposed axially between the magnets 942 and the windings 930. In other words, the entire stator 924 may be disposed axially between (i.e., in a direction along or parallel to the rotational axis A) the flange 936 of the stator housing 821 and the magnets 942. During operation of the compressor 810, electrical current may be supplied to the windings 930 of the stator 924, which causes rotation of the rotor 926 (and thus, orbital motion the orbiting scroll member 884) relative to the stator 924 and the first bearing housing 814.

The configuration of the motor assembly 820 described above and shown in the figures allows the motor assembly 820 to be more compact in the axial direction, which allows for a shorter driveshaft 876 and a reduction in the overall axial height of the compressor 810.

Figure 7:
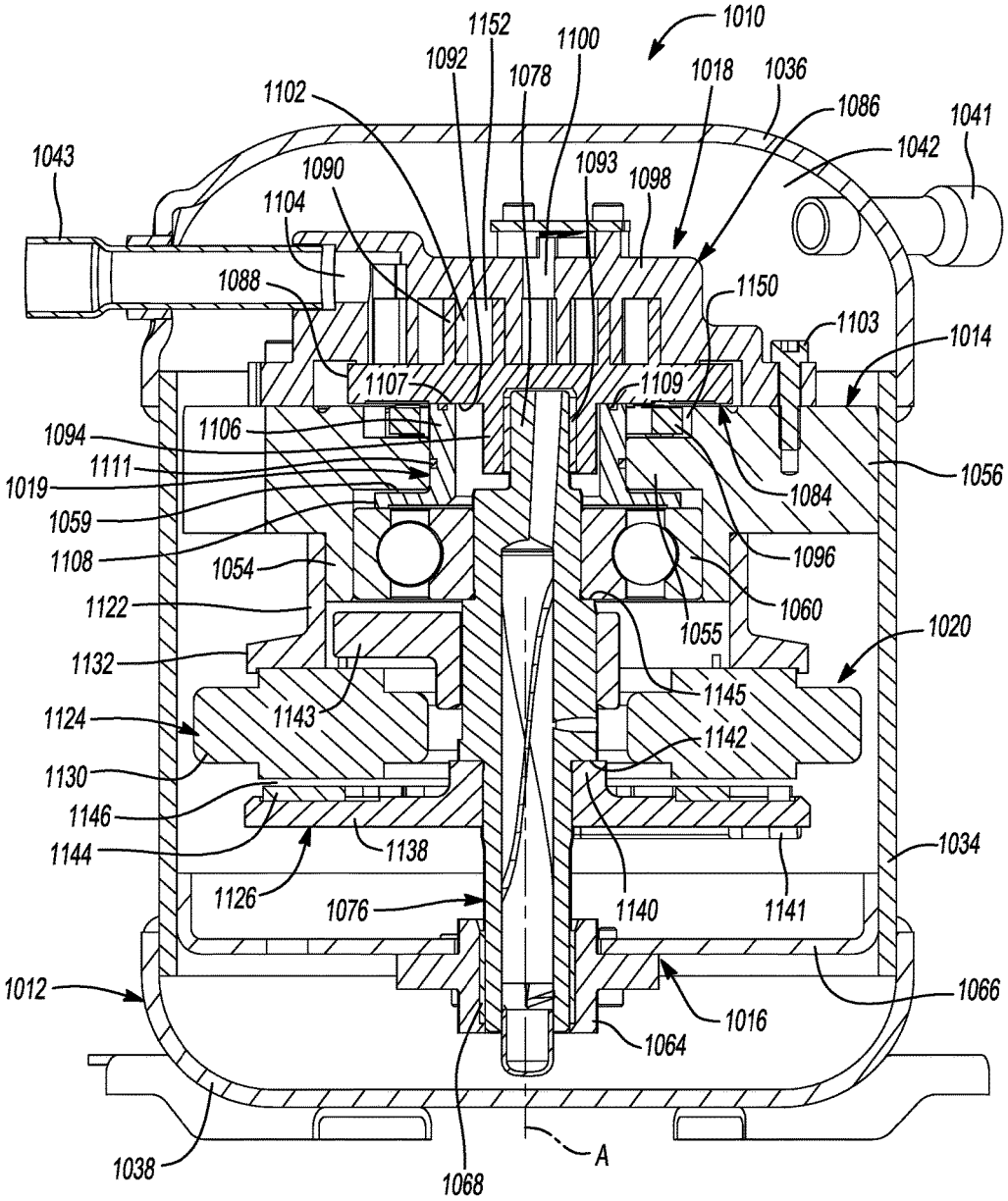
FIG. 7 is a cross-sectional view of yet another compressor according to the principles of the present disclosure.

With reference to FIG. 7, another compressor 1010 is provided that may include a shell assembly 1012, a first bearing housing 1014, a second bearing housing 1016, a compression mechanism 1018, a floating thrust plate 1019, and a motor assembly 1020. The shell assembly 1012 may include a generally cylindrical shell body 1034, an end cap 1036, and a base 1038. The base 1038 may be fixed to a lower end of the shell body 1034. The end cap 1036 may be fixed to an upper end of the shell body 1034. The end cap 1036, the base 1038 and the shell body 1034 may define a discharge chamber 1042 that receives compressed working fluid from the compression mechanism 1018. A discharge outlet fitting 1041 may be attached to the end cap 1036 and is in fluid communication with the discharge chamber 1042. A suction inlet fitting 1043 may be attached to the end cap 1036 and may provide suction-pressure working fluid to the compression mechanism 1018. The suction inlet fitting 1043 may be fluidly isolated from the discharge chamber 1042. The compressor 1010 is a high-side compressor (i.e., the first bearing housing 1014, second bearing housing 1016, compression mechanism 1018, and motor assembly 1020 are disposed within the discharge chamber 1042).

The first bearing housing 1014 may include a central body 1054 and arms 1056 extending radially outward from the central body 1054. The arms 1056 may be fixed to the shell body 1034 via staking or press fit, for example. The central body 1054 may receive a first bearing 1060 (e.g., a roller bearing) and the floating thrust plate 1019. The second bearing housing 1016 may include a central hub 1064 and a support member 1066 extending radially outward therefrom. The central hub 1064 receives a second bearing 1068. The support member 1066 may be attached to the shell body 1034 via staking, welding, or press fit, for example. The first and second bearings 1060, 1068 and the first and second bearing housings 1014, 1016 may rotatably support a driveshaft 1076 that is driven by the motor assembly 1020 and drives the compression mechanism 1018.

The compression mechanism 1018 may include a first compression member and a second compression member that cooperate to define fluid pockets (i.e., compression pockets) therebetween. For example, the compression mechanism 1018 may be an orbital scroll compression mechanism in which the first compression member may be an orbiting scroll member 1084 and the second compression member may be a non-orbiting scroll member 1086 meshingly engaged with the orbiting scroll member 1084. The orbiting scroll member 1084 may include an end plate 1088 having a spiral wrap 1090 on the upper surface thereof and an annular flat thrust surface 1092 on the lower surface. The thrust surface 1092 may interface with the floating thrust plate 1019. A cylindrical hub 1094 may project downwardly from the thrust surface 1092 and may have a drive bushing 1093 rotatably disposed therein. The drive bushing 1093 may include an inner bore receiving an eccentric crank pin 1078 of the driveshaft 1076. A flat surface of the crank pin 1078 may drivingly engage a flat surface in a portion of the inner bore of the drive bushing 1093 to provide a radially compliant driving arrangement. An Oldham coupling 1096 may be engaged with the orbiting scroll member 1084 and the first bearing housing 1014 (or with the orbiting and non-orbiting scroll members 1084, 1086) to prevent relative rotation between the orbiting and non-orbiting scroll members 1084, 1086.

The non-orbiting scroll member 1086 may include an end plate 1098 defining a discharge passage 1100 and having a spiral wrap 1102 extending from the end plate 1098. The end plate 1098 may be attached to the first bearing housing 1014 by fasteners 1103. The end plate 1098 may also include a suction passage 1104 fluidly coupled with the suction inlet fitting 1043 and providing suction-pressure working fluid to the compression pockets.

The floating thrust plate 1019 may be an annular body including an axially extending portion 1106 and a radially extending portion 1108 that extends radially outward from a lower axial end of the axially extending portion 1106. An upper axial end 1107 of the axially extending portion 1106 may contact the thrust surface 1092 of the orbiting scroll member 1084 and may act as a thrust bearing surface that axially supports the orbiting scroll member 1084. A first seal 1109 may engage the upper axial end 1107 and the thrust surface 1092 to provide a sealing relationship between the axially extending portion 1106 and the end plate 1088. The floating thrust plate 1019 is disposed within the central body 1054 of the first bearing housing 1014 and is movable relative to the first bearing housing 1014 in an axial direction (i.e., in a direction along or parallel to a rotational axis A of the driveshaft 1076).

The central body 1054 of the first bearing housing 1014 may include a radially inwardly extending flange 1055 that sealingly engages the axially extending portion 1106 of the floating thrust plate 1019. A second seal 1111 may facilitate the sealed engagement between the flange 1055 and the axially extending portion 1106. The flange 1055 may be disposed axially between the radially extending portion 1108 of the floating thrust plate 1019 and the end plate 1088 of the orbiting scroll member 1084. The radially extending portion 1108 may be axially supported by the first bearing 1060. A gap 1059 may be disposed axially between the radially extending portion 1108 and the flange 1055 that allows clearance from the floating thrust plate 1019 to move axially relative to the first bearing housing 1014.

The motor assembly 1020 may be an axial flux motor including a stator housing 1122, a stator 1124 and a rotor 1126. The stator housing 1122 may be an annular body and may be fixedly attached to the first bearing housing 1014. The stator 1124 may include a plurality of windings 1130 arranged in a circular pattern that encircles the driveshaft 1076. The stator 1124 may be fixedly mounted to the stator housing 1122. For example, the stator 1124 may be mounted to a radially extending flange 1132 of the stator housing 1122.

The rotor 1126 may fixedly engage the driveshaft 1076 and is rotatable with the driveshaft 1076 relative to the stator 1124, the bearing housings 1014, 1016, and the stator housing 1122. The rotor 1126 may include a generally disk-shaped main body 1138 and a central hub 1140 extending axially from the main body 1138. The central hub 1140 of the rotor 1126 may fixedly receive the driveshaft 1076 via press fit, for example. An axial end of the central hub 1140 may abut a first radially extending annular shoulder 1142 formed on the driveshaft 1076. A lower counterweight 1141 may be attached to the main body 1138 of the rotor 1126. An upper counterweight 1143 may be fixedly attached to the driveshaft 1076 at any suitable location, such as a location axially between the annular shoulder 1142 and the first bearing 1060. The driveshaft 1076 may also include a second radially extending annular shoulder 1145 that contacts and axially supports the first bearing 1060. The first and second annular shoulders 1142, 1145 are axially spaced apart from each other (i.e., spaced apart in a direction extending along or parallel to the rotational axis A of the driveshaft 1076) and are axially spaced apart from the eccentric crank pin 1078.

The main body 1138 of the rotor 1126 extends radially outward from the central hub 1140 and is axially spaced apart (i.e., spaced apart in a direction extending along or parallel to the rotational axis A of the driveshaft 1076) from the stator 1124. The rotor 1126 may include a plurality of magnets 1144 that are fixedly attached to the main body 1138 such that the magnets 1144 are axially spaced apart (i.e., spaced apart in a direction extending along or parallel to the rotational axis A) from the stator 1124 such that an air gap 1146 is disposed axially between the magnets 1144 and the windings 1130.

During operation of the compressor 1010, electrical current may be supplied to the windings 1130 of the stator 1124, which causes rotation of the rotor 1126 (and thus, orbital motion the orbiting scroll member 1084) relative to the stator 1124 and the first bearing housing 1014. A magnetic flux through the air gap 1146 between the magnets 1144 and the windings 1130 in an axial direction parallel to the rotational axis A creates a magnetic attraction between the magnets 1144 and the windings 1130 that forces the rotor 1126 toward the stator 1124 in an axial direction (i.e., a direction along or parallel to the rotational axis A). This axial magnetic force urges the rotor 1126 axially upward. Since the rotor 1126 abuts the first annular shoulder 1142 of the driveshaft 1076, the axial magnetic force urges the driveshaft 1076 axially upward. Since the second annular shoulder 1145 of the driveshaft 1076 abuts the first bearing 1060, the upward biasing of the driveshaft 1076 urges the first bearing 1060 axially upward, which urges the floating thrust plate 1019 axially upward (since the floating thrust plate 1019 is axially supported by the first bearing 1060). The upward axial biasing of the floating thrust plate 1019 urges the orbiting scroll member 1084 axially upward toward the non-orbiting scroll member 1086. Such axial biasing of the orbiting scroll member 1084 toward the non-orbiting scroll member 1086 maintains a sealed relationship between the tips of the spiral wrap 1102 and the end plate 1088 and between the tips of the spiral wrap 1090 and the end plate 1098, thereby preventing leakage between the wraps 1102, 1090 and end plates 1088, 1098. Furthermore, such axial biasing also helps to keep the scroll members 1084, 1086 loaded at startup of the compressor 1010, which increases discharge pressure at startup.

Furthermore, the annular seals 1109, 1111, the end plate 1098 and the first bearing housing 1014 may cooperate to define an annular chamber 1150. The annular chamber 1150 may receive intermediate-pressure working fluid (at a pressure greater than suction pressure and less than discharge pressure) from an intermediate fluid pocket 1152 via a passage (not shown) in the end plate 1088. Intermediate-pressure working fluid in the annular chamber 1150 assists in biasing the end plate 1088 in the axial direction toward the end plate 1098 to assist in sealing the tips of spiral wraps 1102, 1090 with the end plates 1088, 1098.

Furthermore, the configuration of the motor assembly 1020 described above and shown in the figures allows the motor assembly 1020 to be more compact in the axial direction, which allows for a shorter driveshaft 1076 and a reduction in the overall axial height of the compressor 1010.

Figure 8:
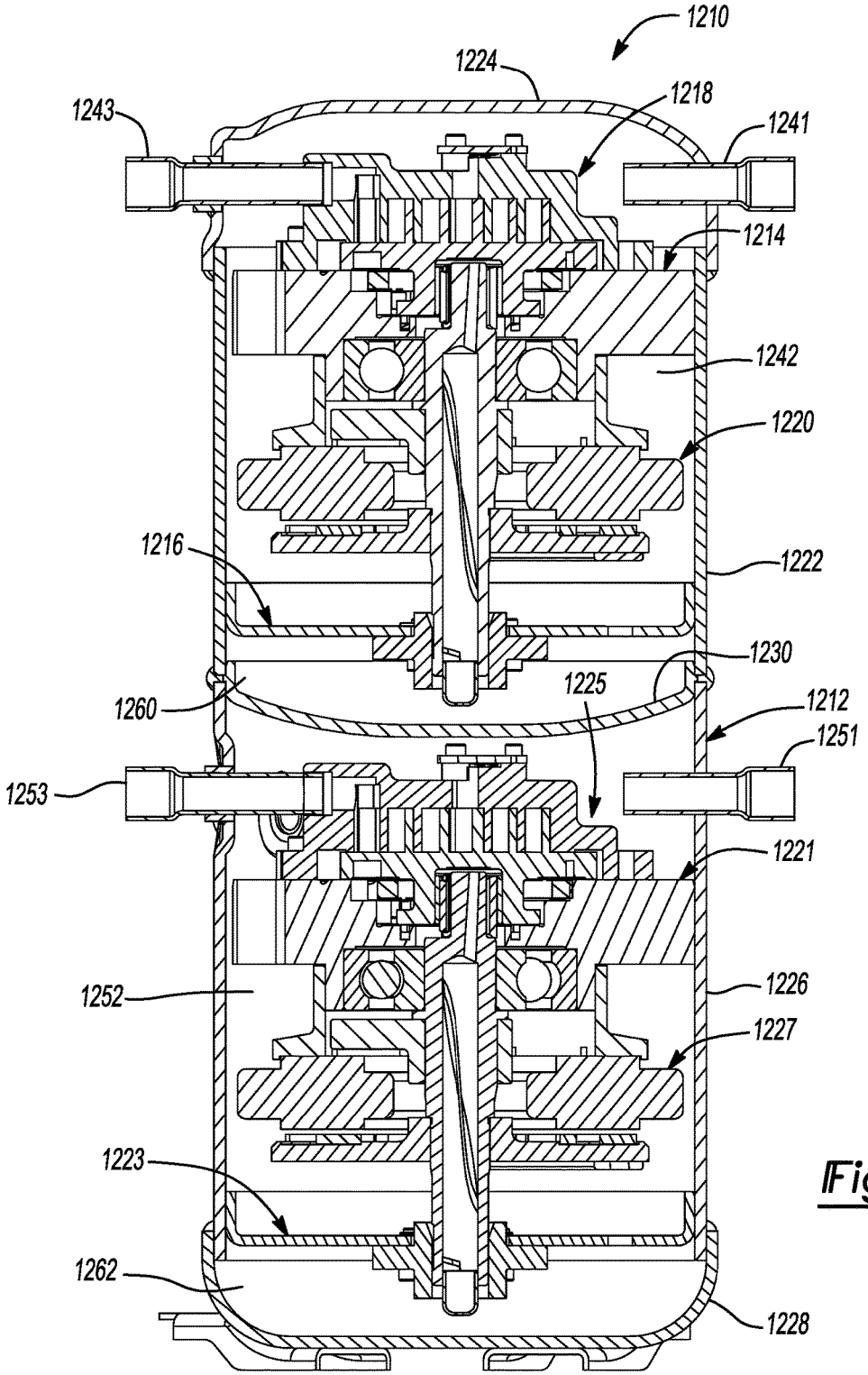
FIG. 8 is a cross-sectional view of yet another compressor according to the principles of the present disclosure.

With reference to FIG. 8, another compressor 1210 is provided that may include a shell assembly 1212, a first bearing housing 1214, a second bearing housing 1216, a first compression mechanism 1218, a first motor assembly 1220, a third bearing housing 1221, a fourth bearing housing 1223, a second compression mechanism 1225, and a second motor assembly 1227.

The shell assembly 1212 may include a first shell body 1222, an end cap 1224, a second shell body 1226, a base 1228, and a partition 1230. The partition 1230 may be fixed to a lower end of the first shell body 1222 and to an upper end of the second shell body 1226. The end cap 1224 may be fixed to an upper end of the first shell body 1222. The end cap 1224 and the first shell body 1222 may define a first discharge chamber 1242 that receives compressed working fluid from the first compression mechanism 1218. A first discharge outlet fitting 1241 may be attached to the end cap 1224 and is in fluid communication with the first discharge chamber 1242. A first suction inlet fitting 1243 may be attached to the end cap 1224 and may provide suction-pressure working fluid to the first compression mechanism 1218. The first suction inlet fitting 1243 may be fluidly isolated from the first discharge chamber 1242. The first shell body 1222 and the partition 1230 may cooperate to define a first lubricant sump 1260. The first bearing housing 1214, second bearing housing 1216, first compression mechanism 1218, and first motor assembly 1220 may be disposed within the first discharge chamber 1242.

The partition 1230 and the second shell body 1226 may define a second discharge chamber 1252 that receives compressed working fluid from the second compression mechanism 1225. A second discharge outlet fitting 1251 may be attached to the second shell body 1226 and is in fluid communication with the second discharge chamber 1252. A second suction inlet fitting 1253 may be attached to the second shell body 1226 and may provide suction-pressure working fluid to the second compression mechanism 1225. The second suction inlet fitting 1253 may be fluidly isolated from the second discharge chamber 1252. The second shell body 1226 and the base 1228 may cooperate to define a second lubricant sump 1262. The third bearing housing 1221, fourth bearing housing 1223, second compression mechanism 1225, and second motor assembly 1227 may be disposed within the second discharge chamber 1252. While not shown in the figures, in some configurations, the shell assembly 1212 may define first and second suction chambers, whereby the first bearing housing 1214, the second bearing housing 1216, the first compression mechanism 1218, and the first motor assembly 1220 may be disposed within the first suction chamber, and the third bearing housing 1221, the fourth bearing housing 1223, the second compression mechanism 1225, and the second motor assembly 1227 may be disposed within the second suction chamber.

The structure and function of the bearing housings 1214, 1216, 1221, 1223 could be similar or identical to that of any of the bearing housings 14, 16, 214, 216, 414, 416, 614, 616, 814, 816, 1014, 1016 described above. The structure and function of the compression mechanisms 1218, 1225 could be similar or identical to that of any of the compression mechanisms 18, 218, 418, 618, 818, 1018 described above. The structure and function of the motor assemblies 1220, 1227 could be similar or identical to that of any of the motor assemblies 20, 220, 420, 620, 820, 1020 described above. Accordingly, the bearing housings 1214, 1216, 1221, 1223, compression mechanisms 1218, 1225, and motor assemblies 1220, 1227 will not be described again in detail.

The configuration of the motor assemblies 1220, 1227 described above (i.e., the configurations of the motor assemblies 20, 220, 420, 620, 820, 1020) allows two independently operable compression mechanisms 1218, 1225 and two independently operable motor assemblies 1220, 1227 to be packaged within the single shell assembly 1212 while maintaining a reasonably compact overall size of the compressor 1210. Furthermore, the configuration of the compressor 1210 described above allows the compression mechanisms 1218, 1225 to be incorporated into a system in which the compression mechanism 1218 compresses one type of refrigerant and the compression mechanism 1225 compresses a different type of refrigerant.

The compression mechanisms 1218, 1225 may have the same capacities or different capacities. Both of the motor assemblies 1220, 1227 may be fixed-speed motors, both of the motor assemblies 1220, 1227 may be variable-speed motors, or one of the motor assemblies 1220, 1227 may be a fixed-speed motor and the other of the motor assemblies 1220, 1227 may be a variable-speed motor. Furthermore, in some configurations, one or both of the compression mechanisms 1218, 1225 can be equipped with capacity modulation means (e.g., vapor injection, modulated suction valves, variable-volume ratio vales, etc.).

While the compression mechanisms 1218, 1225 shown in FIG. 8 are scroll compression mechanisms, in some configurations, one or both of the compression mechanisms 1218, 1225 could be a rotary compression mechanism, a reciprocating compression mechanism, a screw compression mechanism, or any other type of compression mechanism.

Figure 9:
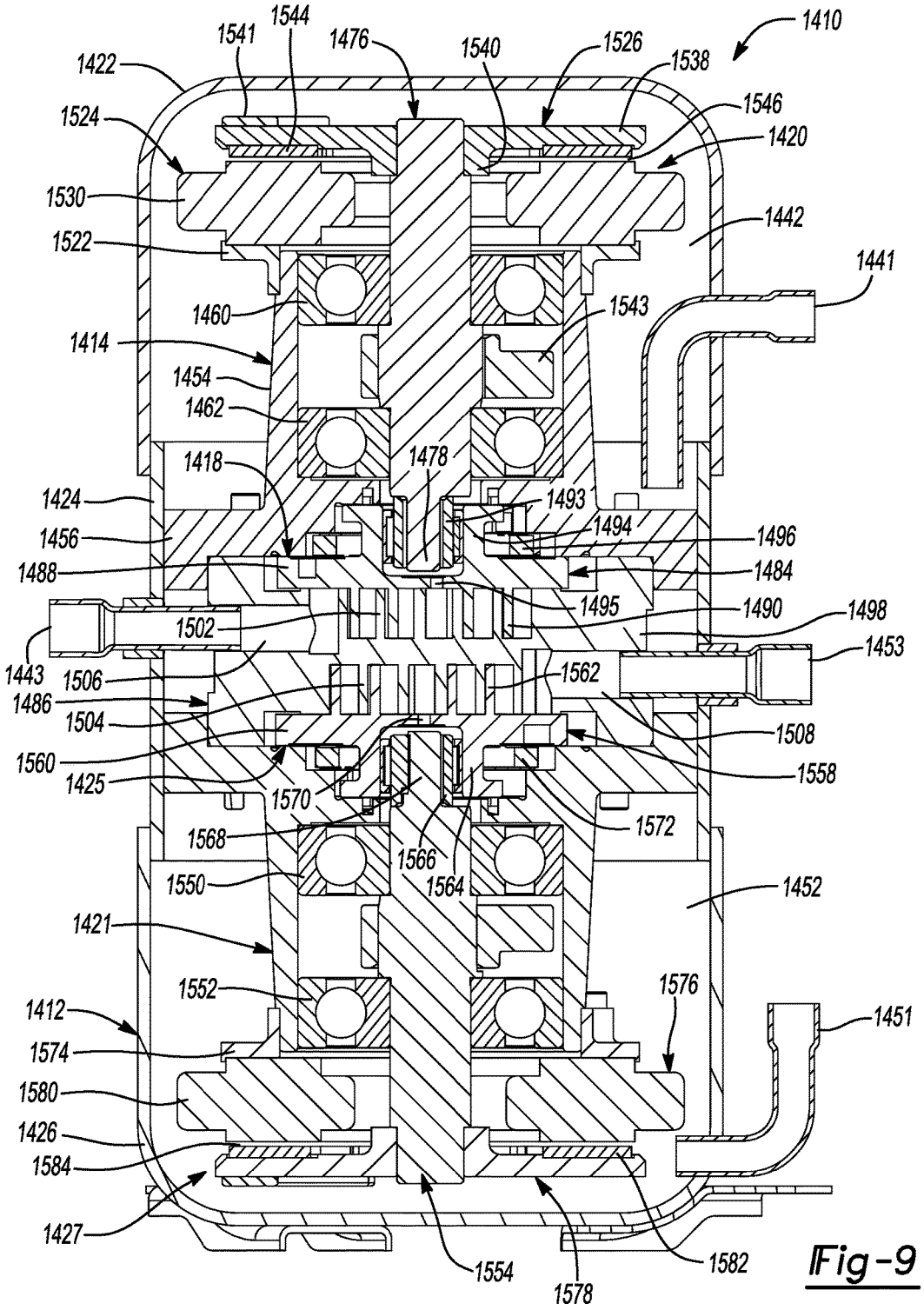
FIG. 9 is a cross-sectional view of yet another compressor according to the principles of the present disclosure.

With reference to FIG. 9, another compressor 1410 is provide that may include a shell assembly 1412, a first bearing housing 1414, a first compression mechanism 1418, a first motor assembly 1420, a second bearing housing 1421, a second compression mechanism 1425, and a second motor assembly 1427.

The shell assembly 1412 may include a first shell body 1422, a second shell body 1424, and a third shell body 1426. The second shell body 1424 may be disposed axially between the first and third shell bodies 1422, 1426 and may be fixedly attached to ends of the first and third shell bodies 1422, 1426. The first and second shell bodies 1422, 1424 and the first bearing housing 1414 may define a first discharge chamber 1442 that receives compressed working fluid from the first compression mechanism 1418. A first discharge outlet fitting 1441 may be attached to the first shell body 1422 and is in fluid communication with the first discharge chamber 1442. A first suction inlet fitting 1443 may be attached to the second shell body 1424 and may provide suction-pressure working fluid to the first compression mechanism 1418.

The second and third shell bodies 1424, 1426 and the second bearing housing 1421 may define a second discharge chamber 1452 that receives compressed working fluid from the second compression mechanism 1425. A second discharge outlet fitting 1451 may be attached to the third shell body 1426 and is in fluid communication with the second discharge chamber 1452. A second suction inlet fitting 1453 may be attached to the second shell body 1424 and may provide suction-pressure working fluid to the second compression mechanism 1425.

The first bearing housing 1414 may include a central body 1454 and an outer flange 1456 extending radially outward from the central body 1454. The outer flange 1456 may be fixed to the second shell body 1424 via staking or press fit, for example. The central body 1454 may receive a first bearing 1460 and a second bearing 1462 (e.g., roller bearings). The first and second bearings 1460, 1462 and the first bearing housing 1414 may rotatably support a first driveshaft 1476 that is driven by the first motor assembly 1420 and drives the first compression mechanism 1418.

The first compression mechanism 1418 may include a first compression member and a second compression member that cooperate to define fluid pockets (i.e., compression pockets) therebetween. For example, the compression mechanism 1418 may be an orbital scroll compression mechanism in which the first compression member may be a first orbiting scroll member 1484 and the second compression member may be a non-orbiting scroll member 1486 meshingly engaged with the first orbiting scroll member 1484.

The first orbiting scroll member 1484 may include an end plate 1488 having a spiral wrap 1490 extending from one side of the end plate 1488 and a cylindrical hub 1494 extending from the opposite side of the end plate 1488. A drive bushing 1493 may be disposed within the hub 1494 and may receive an eccentric crank pin 1478 of the first driveshaft 1476. The end plate 1488 may define a discharge passage 1495 through which compressed working fluid in the first compression mechanism 1418 flows into the first discharge chamber 1442. A flat surface of the crank pin 1478 may drivingly engage a flat surface in a portion of the inner bore of the drive bushing 1493 to provide a radially compliant driving arrangement. A first Oldham coupling 1496 may be engaged with the first orbiting scroll member 1484 and the first bearing housing 1414 (or with the first orbiting scroll member 1484 and the non-orbiting scroll member 1486) to prevent relative rotation between the first orbiting scroll member 1484 and the non-orbiting scroll member 1486.

The non-orbiting scroll member 1486 may include an end plate 1498 having a first spiral wrap 1502 extending from one side of the end plate 1498 and a second spiral wrap 1504 extending from the opposite side of the end plate 1498. The first spiral wrap 1502 may be meshingly engaged with the spiral wrap 1490 of the first orbiting scroll member 1484 to form compression pockets therebetween. The end plate 1498 may be fixedly attached to the first and second bearing housings 1414, 1421. The end plate 1498 may include a first suction passage 1506 fluidly coupled with the first suction inlet fitting 1443 and providing suction-pressure working fluid to the compression pockets defined by the spiral wraps 1490, 1502. The end plate 1498 may include a second suction passage 1508 fluidly coupled with the second suction inlet fitting 1453 and providing suction-pressure working fluid to compression pockets of the second compression mechanism 1425.

The first motor assembly 1420 may be an axial flux motor including a stator housing 1522, a stator 1524 and a rotor 1526. The stator housing 1522 may be an annular body and may be fixedly attached to the first bearing housing 1414. The stator 1524 may include a plurality of windings 1530 arranged in a circular pattern that encircles the driveshaft 1476. The stator 1524 may be fixedly mounted to the stator housing 1522.

The rotor 1526 may fixedly engage the driveshaft 1476 and is rotatable with the driveshaft 1476 relative to the stator 1524, the first bearing housing 1414, and the stator housing 1522. The rotor 1526 may include a generally disk-shaped main body 1538 and a central hub 1540 extending axially from the main body 1538. The central hub 1540 of the rotor 1526 may fixedly receive the driveshaft 1476 via press fit, for example. A counterweight 1541 may be attached to the main body 1538 of the rotor 1526. Another counterweight 1543 may be fixedly attached to the driveshaft 1476 at any suitable location, such as a location axially between the first and second bearings 1460, 1462.

The main body 1538 of the rotor 1526 extends radially outward from the central hub 1540 and is axially spaced apart (i.e., spaced apart in a direction extending along or parallel to the rotational axis of the driveshaft 1476) from the stator 1524. The rotor 1526 may include a plurality of magnets 1544 that are fixedly attached to the main body 1538 such that the magnets 1544 are axially spaced apart (i.e., spaced apart in a direction extending along or parallel to the rotational axis) from the stator 1524 such that an air gap 1546 is disposed axially between the magnets 1544 and the windings 1530.

As described above, during operation of the first motor assembly 1420, electrical current may be supplied to the windings 1530 of the stator 1524, which causes rotation of the rotor 1526 (and thus, orbital motion the first orbiting scroll member 1484) relative to the stator 1524 and the first bearing housing 1414. A magnetic flux through the air gap 1546 between the magnets 1544 and the windings 1530 in an axial direction parallel to the rotational axis of the driveshaft 1476 creates a magnetic attraction between the magnets 1544 and the windings 1530.

The second bearing housing 1421 may be similar or identical to the first bearing housing 1414, and therefore, will not be described again in detail. Briefly, the second bearing housing 1421 may receive third and fourth bearings 1550, 1552 that rotatably support a second driveshaft 1554. The second driveshaft 1554 is driven by the second motor assembly 1427 and drives the second compression mechanism 1425.

The second compression mechanism 1425 may include a second orbiting scroll member 1558 and the non-orbiting scroll member 1486. The second orbiting scroll member 1558 may include an end plate 1560 having a spiral wrap 1562 extending from one side of the end plate 1560 and a cylindrical hub 1564 extending from the opposite side of the end plate 1560. A drive bushing 1566 may be disposed within the hub 1564 and may receive an eccentric crank pin 1568 of the second driveshaft 1554. The end plate 1560 may define a discharge passage 1570 through which compressed working fluid in the second compression mechanism 1425 flows into the second discharge chamber 1452. A flat surface of the crank pin 1568 may drivingly engage a flat surface in a portion of the inner bore of the drive bushing 1566 to provide a radially compliant driving arrangement. A second Oldham coupling 1572 may be engaged with the second orbiting scroll member 1558 and the second bearing housing 1421 (or with the second orbiting scroll member 1558 and the non-orbiting scroll member 1486) to prevent relative rotation between the second orbiting scroll member 1558 and the non-orbiting scroll member 1486. The second spiral wrap 1504 of the non-orbiting scroll member 1486 may be meshingly engaged with the spiral wrap 1562 of the second orbiting scroll member 1558 to form compression pockets therebetween.

The second motor assembly 1427 may be similar or identical to the first motor assembly 1420, and therefore, will not be described again in detail. Briefly, the second motor assembly 1427 may be an axial flux motor including a stator housing 1574, a stator 1576, and a rotor 1578. The stator 1576 may be fixed to the second bearing housing 1421 (e.g., via the stator housing 1574) and may include windings 1580. The rotor 1578 may be fixed to the second driveshaft 1554 and may rotate with the second driveshaft 1554 relative to the stator 1576 and the second bearing housing 1421. The stator 1576 includes a plurality of magnets 1582. The magnets 1582 are axially spaced apart (i.e., spaced apart in a direction extending along or parallel to the rotational axis of the driveshaft 1554) from the stator 1576 such that an air gap 1584 is disposed axially between the magnets 1582 and the windings 1580.

The configuration of the first and second motor assemblies 1420, 1427 described above and shown in the figures allows the motor assemblies 1420, 1427 to be more compact in the axial direction, which allows for a shorter driveshafts 1476, 1554 and a reduction in the overall axial height of the compressor 1410. Furthermore, the use of the common non-orbiting scroll member 1486 for both compression mechanisms 1418, 1425 also reduces the overall axial height of the compressor 1410.

The configuration of the motor assemblies 1420, 1427 described above allows two independently operable compression mechanisms 1418, 1425 and two independently operable motor assemblies 1420, 1427 to be packaged within the single shell assembly 1412 while maintaining a reasonably compact overall size of the compressor 1410. Furthermore, the configuration of the compressor 1410 described above allows the compression mechanisms 1418, 1425 to be incorporated into a system in which the compression mechanism 1418 compresses one type of refrigerant and the compression mechanism 1425 compresses a different type of refrigerant.

The compression mechanisms 1418, 1425 may have the same capacities or different capacities. Both of the motor assemblies 1420, 1427 may be fixed-speed motors, both of the motor assemblies 1420, 1427 may be variable-speed motors, or one of the motor assemblies 1420, 1427 may be a fixed-speed motor and the other of the motor assemblies 1420, 1427 may be a variable-speed motor. Furthermore, in some configurations, one or both of the compression mechanisms 1418, 1425 can be equipped with capacity modulation means (e.g., vapor injection, modulated suction valves, variable-volume ratio vales, etc.).

While the compression mechanisms 1418, 1425 shown in FIG. 9 are scroll compression mechanisms, in some configurations, one or both of the compression mechanisms 1418, 1425 could be a rotary compression mechanism, a reciprocating compression mechanism, a screw compression mechanism, or any other type of compression mechanism.

While the motor assemblies 20, 220, 420, 620, 820, 1020, 1220, 1227, 1420, 1427 are described above as having a single stator and a single rotor, in some configurations, any of the motor assemblies could include multiple rotors and/or multiple stators. For example, any of the motor assemblies could include a pair of stators with a single rotor (with magnets on both side of the rotor) disposed between the stators. For another example, any of the motor assemblies could include a stator disposed between two rotors.

The entire disclosures of each of Applicant's commonly owned U.S. Patent Application Publication No. 2018/0223843, U.S. Patent Application Publication No. 2018/0223848, U.S. Patent Application Publication No. 2018/0224171, and U.S. Patent Application Publication No. 2018/0223842 are incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll member having a first end plate and a first spiral wrap extending from the first end plate;

a second scroll member having a second end plate and a second spiral wrap extending from the second end plate and intermeshed with the first spiral wrap to define compression pockets therebetween;

a first bearing housing supporting the first scroll member for rotation about a first rotational axis;

a second bearing housing supporting the second scroll member for rotation about a second rotational axis that is parallel to the first rotational axis and offset from the first rotational axis; and a motor assembly including a stator and a rotor, the stator surrounding the first rotational axis and fixed relative to the first bearing housing, the rotor attached to the first scroll member and rotatable with the first scroll member about the first rotational axis, the rotor including magnets that are arranged around the first rotational axis, the magnets are spaced apart from the stator in an axial direction that is parallel to the first rotational axis, wherein a magnetic attraction between the stator and the rotor forces the first scroll member toward the second scroll member in the axial direction.

2. A compressor comprising:

a first scroll member having a first end plate and a first spiral wrap extending from the first end plate;

a second scroll member having a second end plate and a second spiral wrap extending from the second end plate and intermeshed with the first spiral wrap to define compression pockets therebetween;

a first bearing housing supporting the first scroll member for rotation about a first rotational axis;

a second bearing housing supporting the second scroll member for rotation about a second rotational axis that is parallel to the first rotational axis and offset from the first rotational axis; and a motor assembly including a stator and a rotor, the stator surrounding the first rotational axis and fixed relative to the first bearing housing, the rotor attached to the first scroll member and rotatable with the first scroll member about the first rotational axis, the rotor including magnets that are arranged around the first rotational axis, the magnets are spaced apart from the stator in an axial direction that is parallel to the first rotational axis, wherein the rotor includes a discharge passage that provides fluid communication between one of the compression pockets and a discharge chamber defined by a shell assembly of the compressor.

3. The compressor of claim 2, wherein the discharge passage includes an axially extending portion through which the first rotational axis extends and a radially extending portion that extends radially outward from the axially extending portion.

4. The compressor of claim 3, wherein the radially extending portion includes at least one outlet that directs working fluid toward the stator.

5. The compressor of claim 1, wherein a portion of the rotor is received within a hub of the first scroll member, and wherein the first bearing housing supports the hub for rotation about the first rotational axis.

6. The compressor of claim 1, wherein the rotor includes a radially extending portion that extends radially relative to the first rotational axis and an axially extending portion that extends parallel to the first rotational axis.

7. The compressor of claim 6, wherein the axially extending portion engages the first end plate and surrounds the second scroll member.

8. The compressor of claim 7, further comprising a seal engaging the rotor and the second scroll member, wherein the radially extending portion engages the seal, and wherein the second end plate is disposed between the first end plate and the radially extending portion in the axial direction.

9. A compressor comprising:

a first compression member;

a second compression member that is movable relative to the first compression member, the first and second compression members cooperating to define a compression pocket therebetween; and a motor assembly driving one of the first and second compression members relative to the other one of the first and second compression members, the motor assembly including a stator and a rotor, the rotor is rotatable relative to the stator about a rotational axis, the stator surrounding the rotational axis, the rotor including magnets that are arranged around the rotational axis, the magnets are spaced apart from the stator in an axial direction that is parallel to the rotational axis, wherein a magnetic attraction between the stator and the rotor forces the first compression member toward the second compression member in the axial direction, wherein the first and second compression members are co-rotating first and second scroll members, and wherein the rotor includes a discharge passage that provides fluid communication between the compression pocket and a discharge chamber defined by a shell assembly of the compressor.

10. The compressor of claim 9, wherein the discharge passage includes an axially extending portion through which the rotational axis extends and a radially extending portion that extends radially outward from the axially extending portion.

11. The compressor of claim 10, wherein the radially extending portion includes at least one outlet that directs working fluid toward the stator.

12. A compressor comprising:

a first compression member;

a second compression member that is movable relative to the first compression member, the first and second compression members cooperating to define a compression pocket therebetween; and a motor assembly driving one of the first and second compression members relative to the other one of the first and second compression members, the motor assembly including a stator and a rotor, the rotor is rotatable relative to the stator about a rotational axis, the stator surrounding the rotational axis, the rotor including magnets that are arranged around the rotational axis, the magnets are spaced apart from the stator in an axial direction that is parallel to the rotational axis, wherein a magnetic attraction between the stator and the rotor forces the first compression member toward the second compression member in the axial direction, wherein the first and second compression members are co-rotating first and second scroll members, and wherein a portion of the rotor is received within a hub of the first scroll member, and wherein a first bearing housing supports the hub for rotation.

13. The compressor of claim 12, wherein the rotor includes a discharge passage that provides fluid communication between the compression pocket and a discharge chamber defined by a shell assembly of the compressor.

14. The compressor of claim 13, wherein the discharge passage includes an axially extending portion through which the rotational axis extends and a radially extending portion that extends radially outward from the axially extending portion.

15. The compressor of claim 14, wherein the radially extending portion includes at least one outlet that directs working fluid toward the stator.

* * * * *